US007754957B2

(12) United States Patent
Ohta

(10) Patent No.: US 7,754,957 B2
(45) Date of Patent: Jul. 13, 2010

(54) MUSICAL INSTRUMENT CAPABLE OF PRODUCING AFTER-TONES AND AUTOMATIC PLAYING SYSTEM

(75) Inventor: Tetsuo Ohta, Hamamatsu (JP)

(73) Assignee: Yamaha Corporation, Shizuoka-Ken (JP)

( * ) Notice: Subject to any disclaimer, the term of this patent is extended or adjusted under 35 U.S.C. 154(b) by 106 days.

(21) Appl. No.: 12/051,889

(22) Filed: Mar. 20, 2008

(65) Prior Publication Data

US 2008/0236363 A1 Oct. 2, 2008

(30) Foreign Application Priority Data

Mar. 29, 2007 (JP) ..... 2007-088700

(51) Int. Cl.
*G10H 1/00* (2006.01)

(52) U.S. Cl. ..... 84/615; 84/653

(58) Field of Classification Search ..... 84/615, 84/627, 653, 663

See application file for complete search history.

(56) References Cited

U.S. PATENT DOCUMENTS

| | | | | |
|---|---|---|---|---|
| 3,509,282 | A * | 4/1970 | Ashworth | 381/152 |
| 5,189,242 | A * | 2/1993 | Usa | 84/743 |
| 6,576,826 | B2 * | 6/2003 | Kondo et al. | 84/615 |
| 6,765,142 | B2 * | 7/2004 | Sakurada et al. | 84/719 |
| 6,815,603 | B2 * | 11/2004 | Kato et al. | 84/744 |
| 6,849,796 | B2 * | 2/2005 | Yamaguchi | 84/720 |
| 6,870,151 | B2 * | 3/2005 | Kato | 250/221 |
| 7,002,070 | B2 * | 2/2006 | Katz | 84/718 |
| 7,381,880 | B2 * | 6/2008 | Fujiwara et al. | 84/615 |
| 7,432,428 | B2 * | 10/2008 | Kunisada et al. | 84/13 |
| 7,473,840 | B2 * | 1/2009 | Arimoto | 84/615 |
| 7,514,625 | B2 * | 4/2009 | Suzuki | 84/723 |
| 2001/0003940 | A1 * | 6/2001 | Kondo | 84/1 |
| 2001/0027714 | A1 * | 10/2001 | Kondo et al. | 84/615 |
| 2002/0046640 | A1 * | 4/2002 | Kondo | 84/615 |
| 2002/0194986 | A1 * | 12/2002 | Kato et al. | 84/744 |
| 2003/0015086 | A1 * | 1/2003 | Katz | 84/644 |
| 2003/0131717 | A1 * | 7/2003 | Shiiya | 84/610 |
| 2003/0131720 | A1 * | 7/2003 | Sakurada et al. | 84/719 |
| 2004/0168564 | A1 * | 9/2004 | Koseki et al. | 84/615 |
| 2006/0005691 | A1 * | 1/2006 | Koseki et al. | 84/604 |

FOREIGN PATENT DOCUMENTS

JP 3-269493 12/1991

* cited by examiner

*Primary Examiner*—David S. Warren
(74) *Attorney, Agent, or Firm*—Harness, Dickey & Pierce, PLC

(57) ABSTRACT

An automatic player musical instrument includes an acoustic piano and an electronic system for selectively producing acoustic tones and electronic tones as regular tones equivalent to the tones to be produced for the keys moved toward the end positions and after-tones equivalent to the tones to be produced for the keys moved toward the rest positions, and a controller of the electronic system makes the acoustic piano and an electronic tone generating system produce the after-tones alone or together with the regular tones depending upon user's instruction so that the users can perform or reproduce music tunes in various renditions such as, for example, tremolo, syncopation and vibrato.

20 Claims, 14 Drawing Sheets

MUSICAL INSTRUMENT CAPABLE OF PRODUCING AFTER-TONES AND AUTOMATIC PLAYING SYSTEM

FIELD OF THE INVENTION

This invention relates to a musical instrument and, more particularly, to a musical instrument capable of producing tones in response to both of the depressed keys and released keys.

DESCRIPTION OF THE RELATED ART

There are various sorts of musical instruments, and players perform music tunes on these musical instruments in standard performing techniques. However, the standard performing techniques are different among different sorts of musical instruments.

For example, when the player wishes to produce piano tones, he or she depresses the front portions of the keys. The depressed keys give rise to rotation of hammers, and the hammers are brought into collision with the strings so as to give rise to vibrations of strings. When the player decays the piano tones, he or she releases the keys from the depressed state. The dampers are brought into contact with the vibrating strings on the way of released keys to the rest positions so as to take up the vibrations of strings. Thus, the pianist produces the acoustic piano tones by depressing the keys, and the acoustic piano tones are decayed after the release of depressed keys.

Acoustic tones are usually produced in the harpsichord as follows. When a player depresses the front portion of a key, the jack, which is connected to the rear portion of the key, is lifted, and the string is strongly plucked with the plectrum during the upward movement of the jack. The released key gives rise to the downward movement of jack. The plectrum ducks away from the string. However, the plectrum softly touches the string. Although the plectrum does not make the string strongly excited as that in the upward movement, unique sound is produced. Thus, the player produces the acoustic harpsichord tones through the harpsichord by depressing the keys, and the unique sound follows the acoustic harpsichord tones.

Such unique sound is produced in another sort of musical instrument. While players are performing music tunes on wind musical instruments, they blow their wind musical instruments. When the players cut the blows with their tongues, the tones are stopped, and faint sound is produced.

The unique sound is simulated in electronic musical instruments. An electronic keyboard is disclosed in Japan Patent Application laid-open No. Hei 3-269493. The prior art electronic keyboard includes not only two tone generating systems for the right and left channels but also a tone generating system for the key-off events, and the unique sound is produced through the electronic tone generating system depending upon the released key velocity. Thus, the prior art electronic musical instrument can produce the unique sound as similar to the harpsichord.

However, the human players can produce the unique sound together with the tones only through the electronic tone generator or the acoustic harpsichord by themselves. In other words, both of the unique sound and tones are electronically or acoustically produced by the human players through the acoustic musical instruments or electronic musical instruments. There is not any attempt to produce only the unique sound. Furthermore, there is not any attempt to produce the acoustic tones as at least the unique sound.

SUMMARY OF THE INVENTION

It is therefore an important object of the present invention to provide a musical instrument, which permits a user to select an appropriate style of renditions from a wide variety of candidates.

It is another important object of the present invention to provide an automatic playing system, which is incorporated in the musical instrument.

In accordance with one aspect of the present invention, there is provided a musical instrument for producing regular tones and after-tones comprising plural manipulators moved between respective rest positions and respective end positions, a first timing generator determining a first sort of timing to produce the regular tones equivalent to tones be produced for the manipulators moved toward the end positions, a second timing generator determining a second sort of timing to produce the after-tones equivalent to tones to be produced for the manipulators moved toward the rest positions, and a tone generating system provided in association with the plural manipulators, connected to the first timing generator and the second timing generator and producing acoustic tones as at least one of the regular tones and after-tones at the first sort of timing or the second sort of timing.

In accordance with another aspect of the present invention, there is provided a musical instrument for producing after-tones in a certain mode of operation comprising plural manipulators moved between respective rest positions and respective end positions, a timing generator determining a sort of timing to produce the after-tones equivalent to tones to be produced for the manipulators moved toward the rest positions, and a tone generating system provided in association with the plural manipulators, connected to the timing generator and producing the after-tones without any regular tones in the certain mode of operation.

In accordance with yet another aspect of the present invention, there is provided an automatic playing system for producing acoustic tones through an acoustic musical instrument comprising a controller processing pieces of music data expressing at least regular tones equivalent to tones to be produced for manipulators of the acoustic musical instrument moved toward respective end positions so as to determine other pieces of music data expressing attributes of after-tones equivalent to tones to be produced for the manipulators moved toward respective rest positions, and plural actuators provided in association with the manipulators and responsive to the other pieces of music data so as to give rise to the movements of the manipulators toward the rest positions for producing the acoustic tones as the after-tones.

BRIEF DESCRIPTION OF THE DRAWINGS

The features and advantages of the musical instrument and automatic playing system will be more clearly understood from the following description taken in conjunction with the accompanying drawings in which.

DESCRIPTION OF THE PREFERRED EMBODIMENTS

Figure 1:
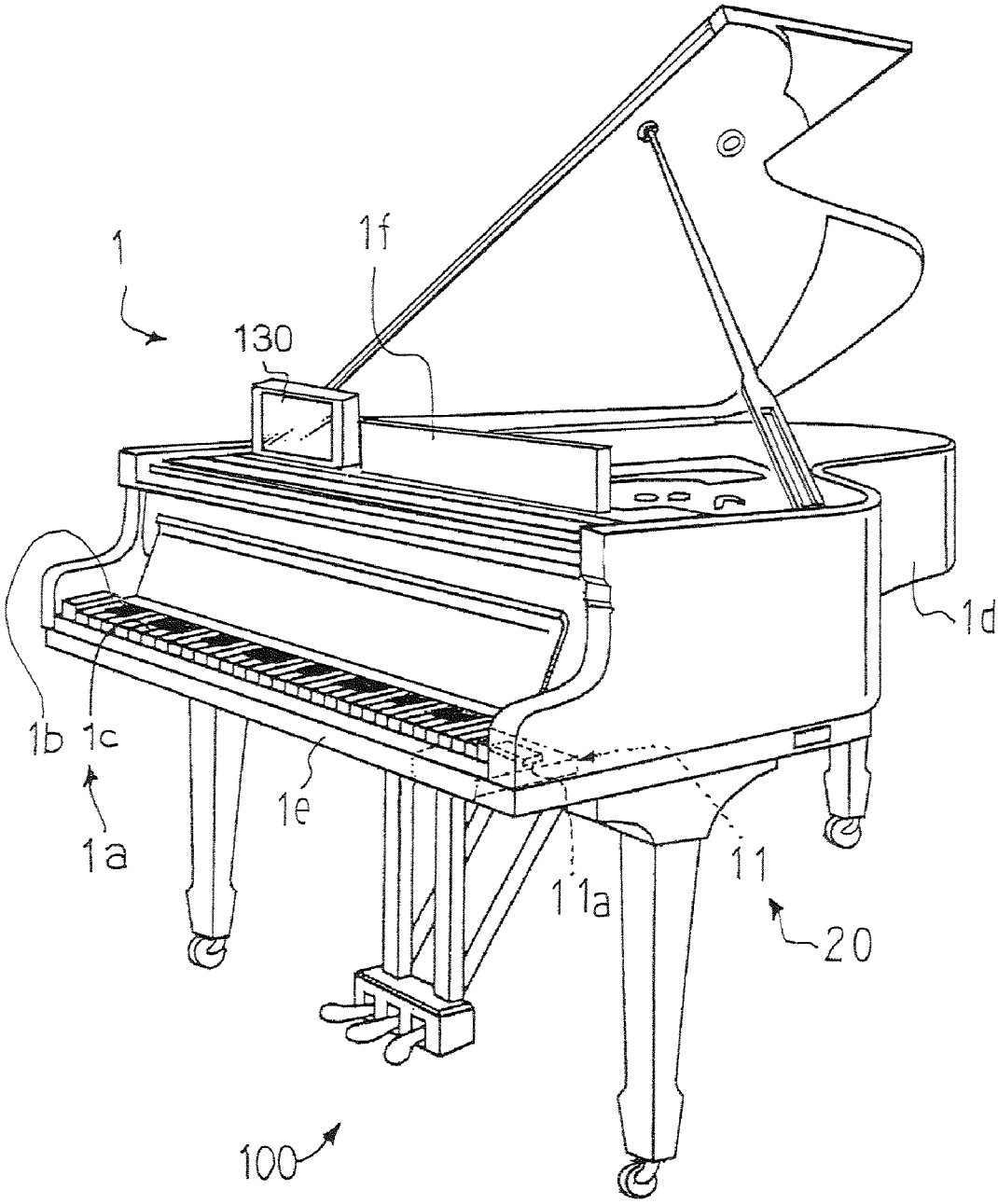
FIG. 1 is a schematic perspective view showing the appearance of an automatic player musical instrument of the present invention.

A musical instrument embodying the present invention is adapted to produce regular tones and after-tones, and comprises plural manipulators, a first timing generator, a second timing generator and a tone generating system. The manipulators are moved between respective rest positions and respective end positions. The regular tones are equivalent to tones to be produced for the manipulators moved toward end positions of the manipulators, and the after-tones are equivalent to tones to be produced for the manipulators moved toward rest positions of the manipulators.

The first timing generator determines a first sort of timing to produce the regular tones, and the second timing generator determines a second sort of timing to produce the after-tones. The first timing generator and second timing generator are connected to the tone generating system so as to give the first sort of timing and second sort of timing to the tone generating system. The tone generating system is provided in association with the plural manipulators, and is capable of producing acoustic tones.

An attribute of the regular tones such as, for example, the pitch is specified through the plural manipulators or pieces of music data. The tone generating system is responsive to the movements of plural manipulators or pieces of music data so as to produce the acoustic tones as at least one of the regular tones and after-tones at the first sort of timing or the second sort of timing. Since the tone generating system is further capable of producing electronic tones, users can select one of the combinations among the acoustic tones, electronic tones and silence for their performance or playback.

Another musical instrument embodying the present invention has a certain mode of operation where only the after-tones are produced, and comprises plural manipulators, a timing generator and a tone generating system. The plural manipulators are also moved between respective rest positions and respective end positions, and the timing generator determines a sort of timing to produce the after-tones. The tone generating system is provided in association with the plural manipulators, and is connected to the timing generator. While the musical instrument is operating in the certain mode of operation, the tone generating system is responsive to the timing generator so as to produce only the after-tones without any regular tones. The listeners feel the after-tones without any regular tones like the tones performed in the syncopation. Thus, the musical instrument makes the style of renditions widened.

An automatic playing system embodying the present invention is used for retrofitting an acoustic musical instrument to the above-described musical instruments of the present invention. The automatic playing system comprises a controller and actuators. The actuators are provided in association with manipulators of the acoustic musical instrument, and the controller is connected to the actuators so as to give rise to movements of the manipulators.

While the regular tones and after-tones are being produced along a music tune, the controller processes pieces of music data expressing at least the regular tones so as to determine other pieces of music data expressing attributes of the after-tones. Then, the actuators are driven by the controller to give rise to the movements of manipulators toward the rest positions, and the acoustic tones are produced through the acoustic musical instrument as the after-tones. Users retrofit the acoustic musical instrument to the musical instrument of the present invention by installing the automatic playing system in the acoustic musical instrument.

In the following description, term "front" is indicative of a point closer to a player, who is fingering, than a point modified with term "rear" position. Line drawn between a front point and a rear point extends in "longitudinal" direction, and "lateral direction" crosses the longitudinal direction at right angle. Up-and-down direction is normal with a plane defined by the longitudinal direction and lateral direction.

While any force is not being exerted on the front portion of a key, the key stays at a rest position. When force is exerted on the front portion of a key, the key starts to travel on a locus from the rest position. The key is terminated at a certain position, and the certain position is referred to as an "end position". Term "depressed key" is a key on the way toward the end position. When the force is removed from the key on the way toward the end position or at the end position, the key starts to return toward the rest position. The key on the way toward the rest position is referred to as "released key".

First Embodiment

Figure 2:
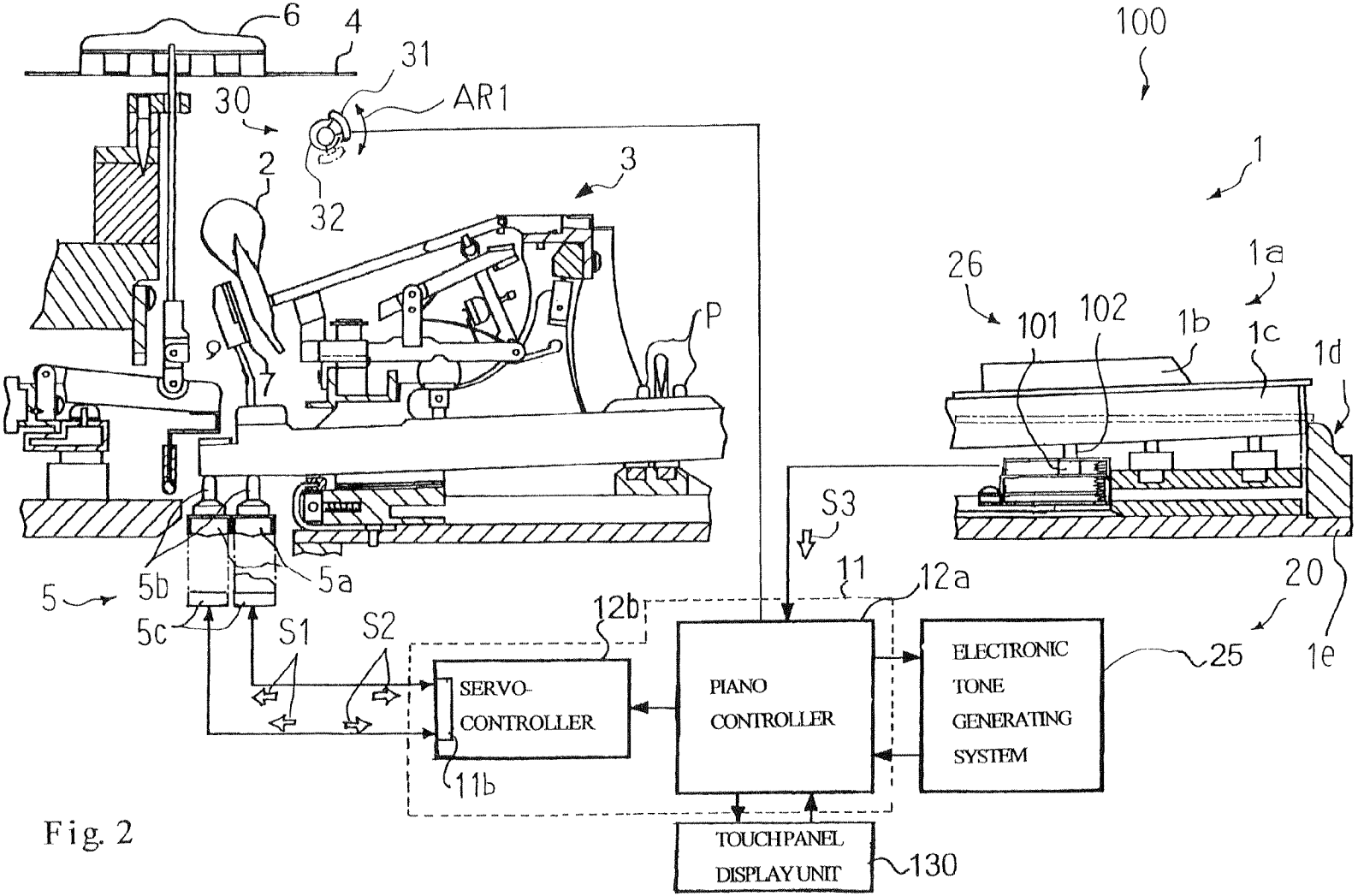
FIG. 2 is a cross sectional side view showing the structure of the automatic player musical instrument.

Referring first to FIGS. 1 and 2 of the drawings, an automatic player musical instrument 100 embodying the present invention largely comprises a grand piano 1, an electronic system 20 and a muting system 30. The grand piano 1 has a capability to produce acoustic piano tones, and makes the acoustic piano tones decayed as similar to a standard grand piano. The electronic system 20 has a capability to produce electronic tones and another capability to finger music tunes on the grand piano 1 without any fingering of a human player. The muting system 30 is installed inside the grand piano 1. The muting system 30 permits the grand piano 1 to produce the acoustic piano tones, and prohibits the grand piano 1 from the production of acoustic piano tones. Thus, the automatic player musical instrument 100 selectively produces two sorts of tones, i.e., the acoustic piano tones and electronic tones.

A computer program, which is installed in the electronic system 20, makes it possible selectively to produce the acoustic tones and electronic tones not only at a certain timing on the way toward the end position but also at another timing on the way toward the rest position. Term "after-tone" is defined as the tone produced at timing on the way toward the rest position. On the other hand, term "regular tone" is defined as the tone produced at the certain timing on the way toward the end position.

When a user makes the automatic player musical instrument 100 it possible to produce only the regular tones, the mode of operation is hereinafter referred to as "the first performance mode". In "the second performance mode", only the after-tones are produced through the automatic player musical instrument 100, and both of the regular tones and after-tones are produced in the "third performance mode".

The first, second, third and fourth tone generation modes are defined as follows. When the automatic player musical instrument 100 is established in the first tone generation mode, the electronic tones are produced as the regular tones, and the acoustic piano tones are produced as the after-tones. The second tone generation mode makes the automatic player musical instrument 100 produce the acoustic piano tones as the regular tones and the electronic tones as the after-tones. The automatic player musical instrument 100 produces the electronic tones not only as the regular tones but also the after-tones. The acoustic piano tones are produced through the automatic player musical instrument 100 as both of the regular tones and after-tones.

There are many combinations between the performance modes and tone generation modes. For example, a user is assumed to select the third performance mode and the third tone generation mode. The automatic player musical instrument 100 becomes responsive to the depressed keys and released keys so as to produce the electronic tones for both of the depressed keys 1*b* and 1*c* and released keys 1*b* and 1*c*. The combination between third performance mode and third tone generation mode is referred to as "the first behavior".

On the other hand, if the user selects the second performance mode and second tone generation mode or the second performance mode and third tone generation mode, the automatic player musical instrument 100 gets ready to produce the electronic tones only as the after-tones. The combination between second performance mode and second tone generation mode and the combination between second performance mode and third tone generation mode are referred to as "the second behavior".

The user may select the third performance mode and the fourth tone generation mode. While the user is performing a music tune, the depressed keys and released keys make the automatic player musical instrument 100 produce the acoustic piano tones as the regular tones and after-tones. The combination between third performance mode and fourth tone generation mode is referred to as "the third behavior".

Thus, the automatic player musical instrument 100 behaves in different manners depending upon user's choice so that the users can perform music tunes in their unique style of renditions.

Grand Piano

The grand piano 1 includes a keyboard 1*a*, i.e., an array of black keys 1*b* and white keys 1*c*, hammers 2, action units 3, strings 4, dampers 6 and a piano cabinet 1*d*. The keyboard 1*a* is mounted on a key bed 1*e*, which forms a bottom part of the piano cabinet 1*d*, and the hammers 2, action units 3, strings 4 and dampers 6 are provided inside the piano cabinet 1*d*.

The black keys 1*b* and white keys 1*c* are arrayed in the lateral direction, and pitch up and down on a center rail. Balance key pins P offer the centers of rotation to the black keys 1*b* and white keys 1*c*. The black keys 1*b* and white keys 1*c* are linked with the action units 3 at the intermediate portions thereof and with the dampers 6 at the rear portions thereof. While force is being exerted on the front portions of black keys 1*b* and front portions of white keys 1*c*, the black keys 1*b* and white keys 1*c* travel from the rest positions to the end positions along loci. The black keys 1*b* and white keys 1*c* on the way toward the end positions firstly cause the dampers 6 spaced from the strings 4, and subsequently actuate the associated action units 3. While the dampers 6 are being held in contact with the strings 4, the dampers 6 prohibit the associated strings 4 from vibrations. When the dampers 6 are spaced from the strings 4, the strings 4 get ready to vibrate for producing the acoustic piano tones. Each of the black and white keys 1*b* and 1*c*, which are traveling toward the end positions, is referred to as "depressed key", and each of the black and white keys 1*b* and 1*c*, which are traveling toward the rest positions, is referred to as "released key".

The action units 3 are further linked with the hammers 2, and the hammers 2 are opposed to the strings 4 below the strings 4. For this reason, the movements of depressed keys 1*b* and 1*c* are transmitted through the action units 3 to the hammers 2 so that a human player and the automatic playing system 20 drive the hammers 2 by depressing and releasing the black keys 1*b* and white keys 1*c*.

When a human player depresses a black key 1*b* or a white key 1*c*, the depressed key 1*b* or 1*c* starts to travel from the rest position toward the end position along the locus. While the black key 1*b* or white key 1*c* is traveling from the rest position to the end position, the depressed key 1*b* or 1*c* firstly makes the associated damper 6 spaced from the string 4, and, thereafter, causes the associated action unit 3 to drive the hammer 2 for rotation through escape. The hammer 2 is rotated toward the string 4, and is brought into collision with the string 4 at the end of rotation. Thus, the hammer 2 gives rise to the vibrations pf string 4 at the collision, and the acoustic piano tone is produced through the vibrations of string 4.

The hammer 2 rebounds on the string 4, and is captured by a back check 7 of the action unit 3. When the player releases the depressed key 1*b* or 1*c*, the released key 1*b* or 1*c* starts to travel from the end position toward the rest position backwardly along the locus. The released key 1*b* or 1*c* permits the damper 6 to be brought into contact with the vibrating string 4, and the damper 6 makes the vibrations of string 4 and, accordingly, the acoustic piano tone decayed.

Muting System

The muting system 30 includes a hammer stopper 31 and a stepping motor 31. The hammer stopper 31 is provided between the hammers 2 and the strings 4, and extends in the lateral direction. The stepping motor 32 gives rise to rotation of the hammer stopper 31 in a direction indicated by arrows AR1, and changes the hammer stopper 31 between a blocking position and a free position.

While the stepping motor 32 is keeping the hammer stopper 31 at the free position, the hammer stopper 31 is outside the loci of the hammers 2, and the hammer stopper 31 does not interfere with the movements of hammers 2. However, when a human player makes the stepping motor 32 move the hammer stopper 31 onto the loci of keys 1*b* and 1*c*, although the action units 3 give rise to the rotation of hammers 20*k*, the hammers 2 rebound on the hammer stopper 31 before reaching the strings 4. Thus, the muting system 30 prevents the strings 4 from vibrations at the collision with the hammers 2.

Electronic System

The electronic system 20 includes a controller 11, an array of solenoid-operated key actuators 5, an electronic tone generating system 25, an array of key position sensors 26 and a touch panel display unit 130. The controller 11 is connected to the solenoid-operated key actuators 5, electronic tone generating system 25, key position sensors 26, stepping motor 32 and touch panel display unit 130 so that the solenoid-operated key actuator 5, key position sensors 26, stepping motor 32 and touch panel display unit 130 behave under the supervision of controller 11.

The controller 11 includes an information processing system 11*a*, which in turn has a central processing unit, peripheral processors, a program memory, a working memory, input-and-output circuits and an internal shared bus system, a pulse width modulator 11*b* and a motor driver (not shown). The central processing unit, peripheral processors, program memory, working memory and input-and-output circuits are connected to the internal shared bus system so that the central processing unit is communicable with the other system components through the internal shared bus system. One of the input-and-output circuits is connected to the pulse width modulator, and another input-and-output circuit is connected to the motor driver. Yet another input-and-output circuit has analog-to-digital converters, and the key position sensors 26 are selectively connected to the analog-to-digital converters. Still another input-and-output circuit is connected to the electronic tone generating system 25.

The central processing unit is the origin of information processing capability. A computer program runs on the central processing unit so as to achieve given tasks with the assistance of peripheral processors. The program memory is implemented by non-volatile memory devices such as a ROM (Read Only Memory) device and a hard disc unit. The computer program and pieces of control data are stored in the program memory, and the instruction codes are sequentially transferred from the program memory to the central processing unit.

On the other hand, the working memory is implemented by a RAM (Random Access Memory) device, registers and an electrically erasable and programmable memory device such as a flash memory. A part of the hard disc unit serves as the working memory. While the central processing unit is executing the instructions, it is necessary temporarily to store calculation results and instructions to other system components, and these sorts of temporary data are stored in the working memory.

Music data codes are also temporarily stored in the working memory. In this instance, music data codes are prepared in accordance with the MIDI (Musical Instrument Digital Interface) protocols. The music data codes express key events, i.e., the note-on events and note-off events, time periods between the key events and the next key events and other control messages. The music data codes for the key events are hereinafter referred to as "key event data codes", and the key event data codes are classified into "note-on key event data codes" and "note-off key event data codes". The music data codes for the time periods are referred to as "duration data codes".

The computer program is broken down into a main routine program and subroutine programs. While the main routine program is running on the central processing unit, visual images, which express prompt messages, a menu of Jobs and a status report, are produced on the touch panel display unit 130, and the central processing unit accepts user's instructions and user's choice through the touch panel display unit 130. Another job in the main routine program is to control the muting system 30 depending upon the user's choice. When the user selects the electronic tones without generation of acoustic piano tones, the central processing unit checks the current position of the hammer stopper 31 to see whether or not the hammer stopper 31 is found at the blocking position. If the answer is affirmative, the central processing unit makes the motor driver keep the hammer stopper 31 at the blocking position. On the other hand, if the answer is given negative, the central processing unit supplies a control signal to the motor driver so as to make the stepping motor 32 rotate the hammer stopper 31 to the blocking position. Thus, the automatic player musical instrument 100 gets ready for the generation of electronic tones without any acoustic piano tones. Thereafter, the main routine program selectively branches to the subroutine programs depending upon the user's choice.

One of the subroutine programs runs on the central processing unit for a performance through the electronic tones. A user plays a piece of music in a live performance, or the user instructs the electronic system 20 to reproduce a piece of music through playback. After acceptance of the user's instruction for the live performance or playback, the subroutine program gets ready to run on the central processing unit.

The user is assumed to play a piece of music in the live performance. While the user is fingering on the keyboard 1*a*, the key position sensors 26 vary the key position signals S3 depending upon the current key positions of the keys 1*b* and 1*c*, and the central processing unit analyzes the movements of depressed keys 1*b* and 1*c* and movements of released keys 1*b* and 1*c* so as to produce the music data codes expressing the note-on events and note-off events. The music data codes are supplied from the controller 11 to the electronic tone generating system 25, and the electronic tones are produced on the basis of the music data codes. The electronic tone generating system 25 has a headphone so that the user hears the electronic tones through the headphone without disturbance of neighborhood.

On the other hand, when the user instructs the electronic system 20 to reenact a performance on the basis of a set of music data codes, the set of music data codes is transferred to the working memory. The function of controller 11 is broken down into a "piano controller 12*a*" and a "servo controller 12*b*". The piano controller 12*a* cooperates with the electronic tone generating system 25 for the playback through the electronic tones.

The piano controller 12*a* searches the working memory for the first key event data, and the piano controller 12*a* transfers the first key event data code to the electronic tone generating system 25. The tone generating system 25 produces the first electronic tone on the basis of the first key event data code. Upon the transfer of the first key event data code, the piano controller 12*a* measures the time period from the key event to see whether or not the time period, which is expressed by the duration data code" is expired. When the time period is expired, the piano controller 12*a* transfers the next key event data code or codes to the electronic tone generating system 25. If the second key event data code expresses the note-off event on the first tone, the first tone is decayed. On the other hand, if the second key event expresses the second note-on event, the electronic tone generating system 25 produces the second electronic tone on the basis of the second key event data code. The measurement of time period, data transfer to the electronic tone generating system 25 and search for the next key event are repeated until the end of the playback. Thus, the key event data codes are intermittently transferred to the electronic tone generating system 25 so as to produce the electronic tones through the electronic tone generating system 25.

Another subroutine program is assigned to an automatic playing on a music tune. While the subroutine program for playback is running on the central processing unit, the piano controller 12*a* cooperates with the servo controller 12*b* for the playback through the acoustic piano tones. The pulse width modulator 11*b* forms a servo control loop together with the solenoid-operated key actuators 5, built-in plunger velocity sensors 5*c* and key position sensors 26, and the servo controller 12*b* controls the depressed keys 1*b* and 1*c* and released keys 1*b* and 1*c* through the servo control loop.

When a user instructs the automatic player musical instrument 100 to reenact a performance through the electronic tones, a set of music data codes is transferred to the working memory, and the main routine program starts periodically branch to the subroutine program for the automatic playing.

The piano controller 12*a* searches the working memory for a key event data code to be processed, and determines a reference key trajectory. The piano controller 12*a* informs the servo controller 12*b* of the reference key trajectory, and the servo controller 12*b* forces the black keys 1*b* and white keys 1*c* to travel on the reference key trajectory through the servo control loop for producing the acoustic piano tone. There are two sorts of reference key trajectory i.e. a forward key trajectory for each of the note-on key events and a reference backward key trajectory for each of the note-off events. The reference forward key trajectory and reference backward key trajectory are hereinafter described in detail.

There is a unique point, which is called as a "reference point", on the locus of depressed key 1*b* or 1*c*. The key velocity at the reference point is well proportional to the final hammer velocity immediately before the collision with the strings 4. Since the final hammer velocity is proportional to the loudness of tones produced through the vibrations of strings 4, it is possible to control the loudness of tones by imparting the key velocity at the reference point to the depressed keys 1*b* and 1*c*. The reference forward key trajectory is a series of key positions on the locus in terms of time. If the depressed key 1*b* or 1*c* travels on the reference forward key trajectory, the depressed key 1*b* or 1*c* passes through the reference point at the target key velocity, and the acoustic piano tone is produced at the target loudness at the target time at which the acoustic piano tone is to be produced.

As described in conjunction with the structure of grand piano 1, the acoustic piano tones are decayed at the contact between the dampers 6 and the vibrating strings 4. The reference backward key trajectory is a series of target key position on the locus for the released key 1*b* or 1*c*. If the released key 1*b* or 1*c* travels on the reference backward key trajectory, the released key 1*b* or 1*c* permits the damper 6 to be brought into contact with the vibrating string 4 at the target time at which the acoustic piano tone is to be decayed.

The piano controller 12*a* determines the reference forward key trajectory for the note-on event defined in each of the note-on key event data codes, and the reference backward key trajectory for the note-off event defined in each of the note-off key event data codes. When the reference forward key trajectory or reference backward key trajectory is determined, the values of target key positions are periodically supplied from the piano controller 12*a* to the servo controller 12*b*. The actual key velocity is reported from the built-in plunger sensors 5*c* through the plunger velocity signal S3, and the actual key position is reported from the key position sensors 26 through the key position signals S3.

The servo controller 12*b* calculates a target value of key velocity on the basis of plural values of target key positions for each of the depressed and released key 1*b* or 1*c*, and compares the actual key velocity and actual key position with the target key velocity and target key position to see whether or not the key 1*b* or 1*c* travels on the reference forward key trajectory or reference backward key trajectory. If any difference is not found between the target key velocity and the actual key velocity and between the target key position and the actual key position, the answer is given affirmative, the servo controller 12*b* makes the pulse width modulator 11*b* keep the amount of mean current at the current value. On the other hand, if a non-ignorable difference takes between the target key velocity and the actual key velocity or between the target key position and the actual key position, the servo controller 12*b* instructs the pulse width modulator 11*b* to vary the amount of means current in such a manner that the non-ignorable difference is minimized. As a result, the depressed keys 1*b* and 1*c* are forced to travel on the reference forward key trajectories so as to make the strings 4 struck with the hammers 2 at the target final hammer velocity at the target time to produce the acoustic tones, and the released keys 1*b* and 1*c* are also forced to travel on the reference backward key trajectories so as to make the acoustic piano tones decayed at the target time.

The piano controller 12*a* and servo controller 12*b* repeat the above-described jobs for all the depressed keys 1*b* and 1*c* and all the released keys 1*b* and 1*c* so as to produce and decay the acoustic piano tones along the music passage.

Yet another subroutine program runs on the central processing unit for the generation of after-tones. As described hereinbefore, there are the first, second third and fourth tone generation modes. The acoustic piano tones are produced in the live performance of a human player or in the playback through the automatic player, and the electronic tones are produced in the live performance in the muting performance or in the playback. Preparation works for the after-tones are accomplished through the execution of subroutine program for the after-tones, and the acoustic piano tones and/or electronic tones are produced through the execution of above-described subroutine programs. The subroutine program for the after-tones is hereinlater described in detail.

The solenoid-operated key actuators 5 are respectively associated with the black and white keys 1*b* and 1*c*, and are arranged in the lateral direction. A slot is formed in the key bed 1*e* below the rear portions of black keys 1*b* and rear portions of white keys 1*c*, and is elongated in the lateral direction. The solenoid-operated key actuators 5 are accommodated in the slot, and the rear portions of black keys 1*b* and rear portions of white keys 1*c* are upwardly pushed with the associated solenoid-operated key actuators 5.

Each of the solenoid-operated key actuators 5 has a yoke, a solenoid 5*a*, a plunger 5*b* and a built-in plunger velocity sensor 5*c*. The solenoids 5*a* are connected in parallel to the pulse width modulator 11*b* so that the controller 11 can selectively energize the solenoids 5*a* with a driving pulse signal S1. The mean current or duty ratio of driving pulse signals S1 is modulated by the pulse width modulator 11*b* so that the strength of magnetic field is controllable.

While the driving pulse signal S1 is flowing through the solenoid 5*a*, magnetic field is created around the associated plunger 5*b*. Then, the magnetic force is exerted on the plunger 5*b*, and makes the plunger 5*b* upwardly project. While the plungers 5*b* are being retracted in the yoke, the tips of plungers 5*b* is in close proximity to the lower surface of the rear portions of keys 1*b* and 1*c*. When the plunger 5*b* upwardly projects from the yoke, the rear portion of associated key 1*b* or 1*c* is pushed, and the associated key 1*b* or 1*c* starts to travel on the locus toward the end portion. While the plungers 5*b* are projecting from the yoke, the built-in plunger velocity sensors 5*c* produce plunger velocity signals S2, and the plunger velocity signals S2 are supplied from the built-in plunger velocity sensors 5*c* to the controller 11 for the servo control. When the driving pulse signals S1 are removed from the solenoids 5*a*, the plungers 5*b* are retracted into the yoke, and permit the depressed keys 1*b* and 1*c* to return to the rest positions. Thus, the controller 11 selectively actuates the solenoid-operated key actuators 5 for performing music tunes.

The electronic tone generating system 25 includes a tone generator, a digital-to-analog converter, amplifiers and loudspeakers. A waveform memory and an envelope generator form parts of the tone generator. Pieces of waveform data, which express discrete values on the waveforms, are stored in the waveform memory, and are successively read out from the waveform memory so as to produce an audio signal. A predetermined envelope is imparted to the audio signal with the assistance of the envelope generator. When the music data code, which expresses the note-on event, the pieces of waveform data are successively read out from the waveform memory, and the discrete values are restored to the analog audio signal with the predetermined envelope or sound waveform. The analog audio signal is amplified, and, thereafter, is converted to the electronic tone. When the music data code, which expresses the note-off event, reaches the tone generator, the analog audio signal is decayed, and the electronic tone is extinguished.

The array of key position sensors 26 is provided under the front portions of black keys 1*b* and the front portions of white keys 1*c*, and the black keys 1*b* and white keys 1*c* are respectively monitored with the key position sensors 26. The key position sensors 26 convert the current key positions of keys 1*b* and 1*c* to key position signals S3, and the key position signals S3 are supplied from the key position sensors 26 to the controller 11.

Figure 3A:
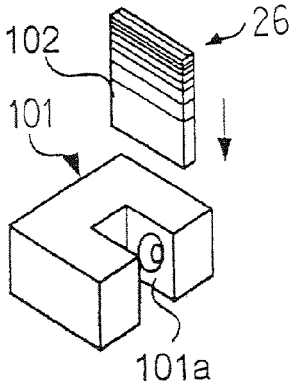
FIG. 3A is a perspective view showing the structure of a key position sensor.
Figure 3B:
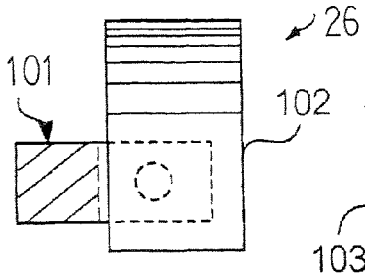
FIG. 3B is a cross sectional side view showing the key sensor.
Figure 3C:
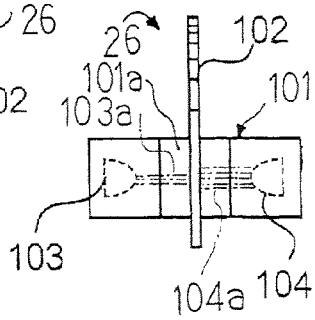
FIG. 3C is a front view showing the key sensor.

FIGS. 3A, 3B and 3C show one of the key position sensors 26. The key position sensor 26 is a combination between a photo-interrupter 101 and an optical modulator 102. The photo-interrupter 101 is provided on the key bed 1*e*, and the optical modulator 102 is secured to the lower surface of associated one of the keys 1*b* and 1*c*. (See FIG. 2.) Thus, the optical modulator 102 is movable with respect to the key bed 1*e*, and the photo-interrupter 101 is stable on the key bed 1*e*.

The photo-interrupter 101 has a light detecting transistor 103, a photo emitting diode 104 and a bracket, which is formed with a gap 101*a*, and the light detecting transistor 103 and light emitting diode 104 are opposed to each other across the gap 101*a*. A light beam 104*a* is radiated from the light emitting diode 104 toward the light detecting transistor 103 across the gap 101*a*, and transmitted light 103*a* is fallen onto the light detecting transistor 103.

The optical modulator 102 is semi-transparent to the light, and the transmission factor of optical modulator 102 is gradually decreased in the upward direction. The locus of the optical modulator 102 passes through the gap 101*a* so that the light beam 104*a* interrupts with the optical modulator 102. The amount of transmitted light 103*a* is varied in dependence on the current position of the optical modulator 102 and, accordingly, the current position of the black key 1*b* or current position of white key 1*c*. Since the relation between the amount of transmitted light 103*a* and the current key position has been stored in the controller 11 as the pieces of control data, the controller 11 looks up the relation so as to determine the current key position.

The touch panel display unit 130 is a combination between a liquid crystal display panel and a matrix switch. One of the peripheral processors produces a visual image signal, and supplies the visual image signal to the liquid crystal display panel. The visual image signal is converted to visual images on an image producing surface of the liquid crystal display panel. The matrix switch is transparent, and has a large number of switches arranged in rows and columns over the image producing surface of liquid crystal display panel. Although the image producing surface is overlapped with the matrix switch, users can see the visual images on the image producing surface of liquid crystal display panel. The user gently depresses an area of the matrix switch over a certain visual image for his or her choice. Since the switches are periodically scanned with a matrix signal, the matrix signal is changed depending upon the area depressed by the user, and the controller 11 determines what visual image the user has depressed. For example, the controller 11 makes visual images of selectable contents on the image producing surface of liquid crystal display panel together with a prompt message, and makes it possible to give an instruction of user to the automatic player musical instrument 100 through the matrix switch. Thus, the touch panel display unit 130 serves as a man-machine interface.

Generation of After-Tones

Figure 4A:
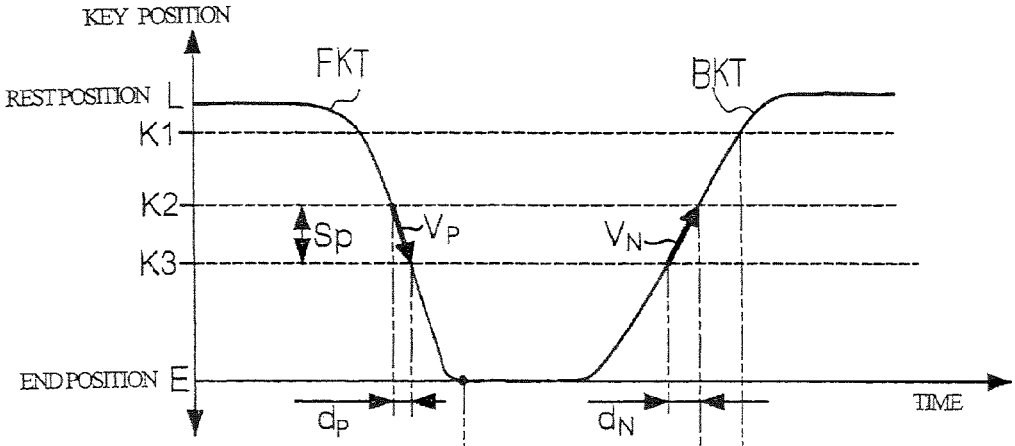
FIG. 4A is a graph showing a forward key trajectory and a backward key trajectory of a key incorporated in the automatic player musical instrument.

A typical key trajectory is shown in FIG. 4A. The keystroke from the rest position is determined on the basis of sampled values of the key position signal S3. One of the black and white keys 1*b*/1*c* starts at the rest position L. The depressed key 1*b* or 1*c* is moved along a forward key trajectory FKT, and reaches the end position E. The depressed key 1*b* or 1*c* stays at the end position E for a while, and starts at the end position E toward the rest position L. The released key 1*b* or 1*c* is moved along a backward key trajectory BKT, and arrives at the rest position L. In other words, the black key 1*b* or white key 1*c* reciprocally travels over the full keystroke between the rest position L and the end position E, and the full keystroke is equal to the distance between the rest position L and the end position E. Three key positions K1, K2 and K3 are determined on the full keystroke so that the full keystroke is divided into four sections, i.e., the first section from L to K1, the second section from K1 to K2, the third section from K2 to K3 and the fourth section from K3 to E.

It is desirable to determine the first key position within 1 millimeter from the rest position L. When the current key position of key 1*b* or 1*c* is fallen within the first section L to K1, the key 1*b* or 1*c* is found in the proximity of rest position L. In other words, the first section from L to K1 is overlapped with the proximity of rest position L.

The third section K2 to K3 is used for calculating the velocity of key 1*b* or 1*c*. The key position K3 is spaced from the key position K2 by distance Sp. The depressed key 1*b* or 1*c* is assumed to consume time period dp. Then, the depressed key velocity Vp is given as Sp/dp. On the other hand, if the released key 1*b* or 1*e* consumes time period dN, the released key velocity VN is given as Sp/dN. Although the depressed key velocity Vp is varied together with the force exerted on the depressed key 1 or 1*c*, it is difficult for a player to control the released key velocity VN. When a human player removes the force from the depressed key 1*b* or 1*c* at the end position, the weight of hammer 2, action unit 3 and damper 6 is exerted on the rear portion of the depressed key 1*b* or 1*e*, and gives rise to the movement of released key 1*b* or 1*c* toward the rest position L. For this reason, the released key velocity VN is dependent on the moment due to the weight of hammer 2, action unit 3 and damper 6. If the player cancels the weight of hammer 2, action unit 3 and damper 6 with his or her finger, the released key velocity VN is decreased. However, it is difficult for the player to increase the released key velocity VN. For this reason, the loudness of after-notes is controlled in dependence on the depressed key velocity Vp, i.e., the loudness of regular tones.

Figure 4B:
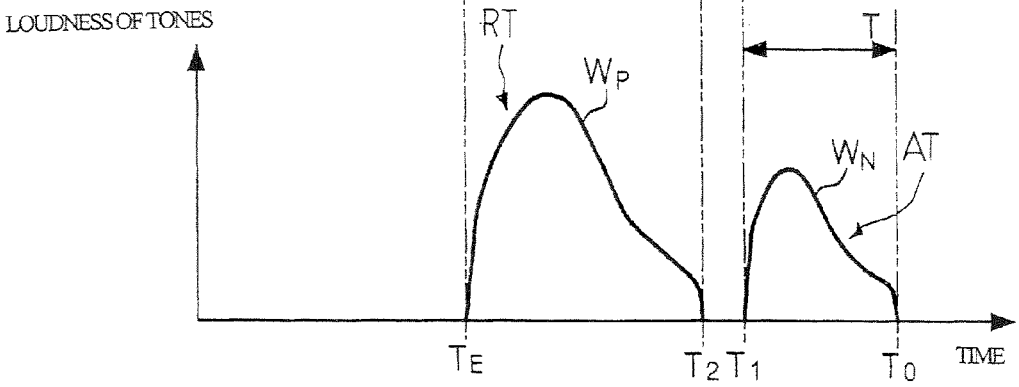
FIG. 4B is a graph showing tones produced on the key trajectories.

FIG. 4B shows the regular tone RT and after-tone AT. The regular tone RT is produced at time TE, at which the depressed key 1*b* or 1*c* reaches the end position, and is decayed at T2, at which the released key 1*b* or 1*c* passes through the key position K2. The regular tone RT is expressed by sound waveform Wp. On the other hand, the after-tone AT is produced at T1, at which the released key passes through the key position K1, and is decayed after arrival at the rest position L. The after-tone AT is expressed by sound waveform WN. When the sound waveform WN is determined, the sound waveform Wp, movement of depressed key 1*b* or 1*c* and movement of released key 1*b* or 1*c* are taken into account.

Figure 5A:
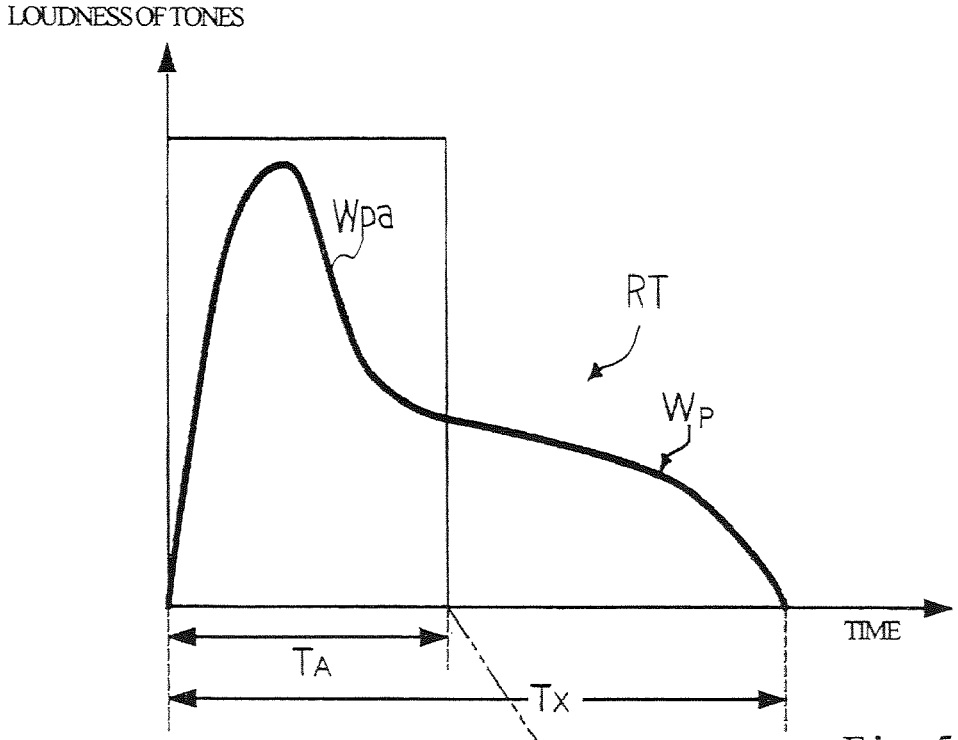
FIG. 5A is a graph showing the sound waveform of a regular tone.
Figure 5B:
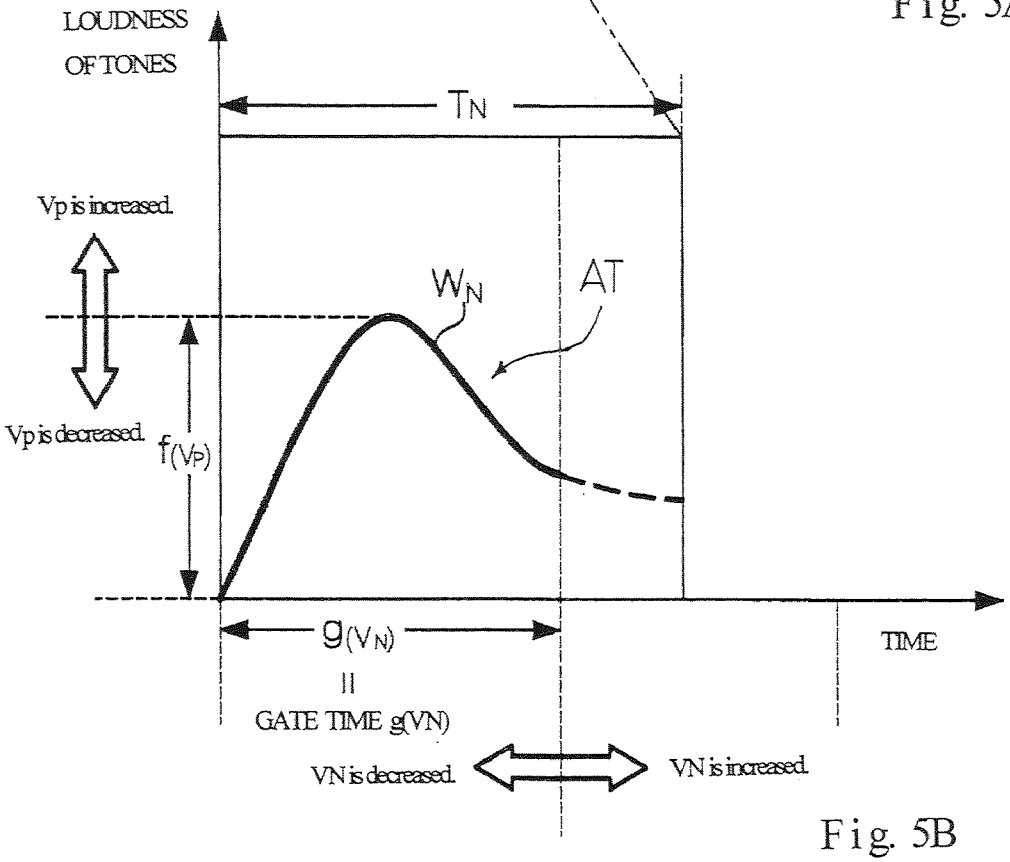
FIG. 5B is a graph showing the sound waveform of an after-tone produced after the regular tone.

Description is hereinafter made on how the after-tone is produced in relation to the regular tone with reference to FIGS. 5A and 5B. FIG. 5A shows the sound waveform of an acoustic piano tone produced as the regular tone RT, and FIG. 5B shows the sound waveform WN of an after-tone AT produced after the acoustic piano tone. As shown in FIG. 5A, the loudness of acoustic piano tone is rapidly raised, and reaches the maximum loudness within a short time period. Thereafter, the loudness is gradually decreased.

The acoustic piano tone is continued over time period Tx. The time period Tx is multiplied by a constant, which is less than 1, and the product expresses time period TA. A part of the sound waveform Wp appears in the time period TA, and is labeled with "Wpa" The sound waveform WN of after-tone AT is determined by expanding or shrinking the part Wpa of the sound waveform Wp not only in the direction of axis of coordinates but also in the direction of abscissa.

In more detail, a function f(Vp) is prepared in the subroutine program for the after-tones. When the depressed key velocity Vp is calculated, the value of depressed key velocity is substituted for Vp in the function f(Vp), and the calculation result is the maximum loudness of after-tone AT. The larger the depressed key velocity Vp is, the larger the maximum loudness of after-tone AT is. The smaller the depressed key velocity Vp is, the smaller the maximum loudness is. Thus, the peak value of sound waveform WN is determined by using the function f(Vp). Time period TN is prepared in the subroutine program for the after-tones. A part Wpa of sound waveform Wp is equivalent to the time period TA, and is approximated in such a manner to have the maximum value f(Vp) and the time period TN. The resultant sound waveform is drawn by both of the real line and broken line in FIG. 5B.

Another function g(VN) is further prepared in the subroutine program for the after-tones. When the released key velocity VN is determined, the value of released key velocity VN is substituted for VN of the function g(VN). The calculation result is referred to as a gate time g(VN), and the resultant sound waveform is partially cut off so that the remaining sound waveform WN is terminated at the end of the gate time g(VN). The larger the released key velocity VN is, the longer the gate time g(VN) is. On the other hand, the smaller the released key velocity VN is, the shorter the gate time g(VN) is. The gate time g(VN) expresses a time period over which the after-tone AT is continued. For this reason, the sound waveform WN is applied to the after-tone AT, and the after-tone AT is produced from T1 to T0 as shown in FIG. 4B.

In order to produce the electronic tone or acoustic piano tone as the after-tone AT, the central processing unit determines the velocity on the basis of the sound waveform WN, and produces the note-on key event data code for the after-tone AT.

Behavior of Automatic Player Musical Instrument

Subsequently, job sequences of the subroutine program for the after-tones are described. While the main routine program is running on the central processing unit, users give their instructions to the automatic player musical instrument 100 through the touch panel display unit 130. In this instance, the function f(Vp) and function g(VN) are expressed as "f(Vp)=B×Vp" and "g(VN)=A/VN", respectively where B is a constant fallen within the range between 0.5 and 1.0 and A is another constant fallen within the range between 5 to 10. Time period TN is equal to or longer than the time period TA, and the time period Tx is equal to or longer than time period TN. Namely, TA≦TN≦Tx.

Figure 6:
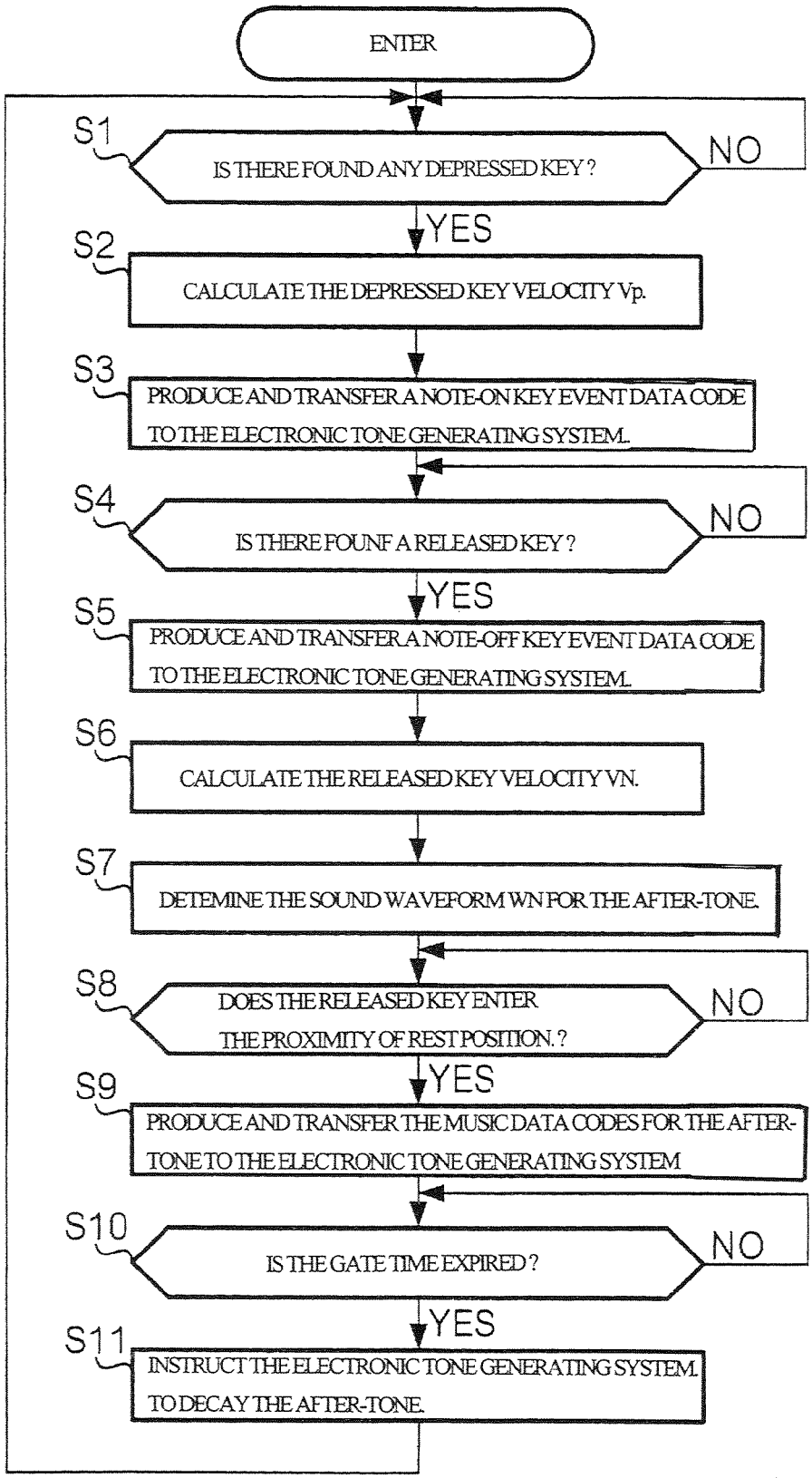
FIG. 6 is a flowchart showing a Job sequence for the first behavior of the automatic player musical instrument.

A user is assumed to select the third performance mode and the first tone generation mode. i.e., the first behavior. In the first behavior, the user fingers a piece of music on the keyboard 1*a*, and the electronic tones are to be produced in response to the fingering on the keyboard 1*a* as the regular tones and after-tones. Therefore, the central processing unit checks the working memory to see whether or not the hammer stopper 31 stays at the blocking position. If the hammer stopper 31 has stayed at the blocking position, the central processing unit makes the stepping motor 32 keep the hammer stopper 32 at the blocking position. On the other hand, if the hammer stopper 31 stays at the free position, the central processing unit supplies the control signal to the motor driver (not shown), and the motor driver starts to supply the driving pulse signal to the stepping motor 32. The stepping motor 32 rotates the hammer stopper 31 until the hammer stopper 31 reaches the blocking position. When the central processing unit confirms that the hammer stopper 31 stays at the blocking position, the main routine program starts periodically to branch to the subroutine program for the after-tones. The job sequence of subroutine program for the first behavior is illustrated in FIG. 6. Although the jobs are repeated in a back and force manner for all of the depressed keys and for all of the released keys, the jobs are straightforwardly arrange in FIG. 6 as if only one of the keys 1*b* and 1*c* is depressed and released.

The central processing unit periodically fetches the pieces of key position data from the input-and-output circuit assigned to the key position signals S3, and are stored in the working memory. The accumulation of pieces of key position data is carried out until the player releases the automatic player musical instrument 100 from the second behavior.

The central processing unit checks the working memory to see whether or not any one of the black and white keys 1*b* and 1*c* as by step S1 passes through the key positions K2 and K3. If all of the black and white keys 1*b* and 1*c* are found at the rest positions, or if the depressed key 1*b* or 1*c* does not reach the key position K3, the answer is given negative "No", and the central processing unit repeats the job at step S1.

When the depressed key 1*b* or 1*c* passes through the key position K2, the central processing unit starts to measure the lapse of time. The central processing unit determines the lapse of time dp at the transit through the key position K3. When the depressed key 1*b* or 1*c* passes through the key position K3, the answer at step S1 is changed to affirmative "Yes". The central processing unit specifies the depressed key 1*b* or 1*c*, and divides the distance Sp by time period dp so as to determine the depressed key velocity Vp as by step S2. Thus, the note number and velocity are determined for the electronic tone to be produced. The sound waveform Wp is determined, and the pieces of music data expressing the sound waveform Wp is stored in the working memory.

Subsequently, the central processing unit produces the note-on key event data code expressing the regular tone to be produced, and transfers the note-on key event data code to the electronic tone generating system 25 as by step S3. The electronic tone is produced through the electronic tone generating system 25 as the regular tone.

The central processing unit checks the working memory to see whether or not the player releases the depressed key 1*b* or 1*c* as by step S4. While the player keeps the depressed key 1*b* or 1*c* at the end position E, and white the released key 1*b* or 1*c* is traveling on the locus before the key position K2, the answer at step S4 is given negative "No". When the released key 1*b* or 1*c* passes through the key position K3, the central processing unit starts to measure the lapse of time. The central processing unit determines the lapse of time dN at the transit through the key position K2. While the answer at step S4 is being given negative, the central processing unit repeats the job at step S4. When the released key 1*b* or 1*c* passes through the key position K2, the answer at step S4 is changed to affirmative "Yes". Then, the central processing unit produces the note-off key event data code for the regular tone, and transfers the note-off key event data code to the electronic tone generating system 25 as by step S5. The electronic tone generating system 25 is responsive to the note-off key event data code so as to make the regular tone decayed.

Subsequently, the central processing unit divides the distance Sp by the time period dN, and determines the released key velocity VN as by step S6. The central processing unit reads out the depressed key velocity Vp and piece of music data expressing the sound waveform Wp from the working memory, and determines the peak value of sound waveform WN, i.e., the maximum loudness of after-tone by substituting the calculated value of depressed key velocity Vp for Vp of the function f(Vp)=B×Vp. The central processing unit shrinks a part of the sound waveform Wp equivalent to the time period TA in the direction of axis of coordinates in such a manner that the resultant sound waveform has the peak value equal to B×Vp. The central processing unit further elongates the part of sound waveform Wp in the direction of axis of abscissa in such a manner as to have the time period TN. Thereafter, the central processing unit determines the gate time by substituting the calculated value of released key velocity VN for the function g(VN)=A/VN. Thus, the central processing unit determines the sound waveform WN for the after-tone, and produces the pieces of music data expressing the sound waveform WN as by step S7.

Subsequently the central processing unit checks the working memory to see whether or not the released key 1*b* or 1*c* enter the proximity of rest position L as by step S8. While the released key 1*b* or 1*c* is traveling toward the key position K1, the answer at step S8 is given negative "No", and the central processing unit repeatedly checks the working memory for the entry into the proximity of rest position L.

When the released key 1*b* or 1*c* passes through the key position K1, the answer at step S8 is changed to affirmative "Yes". With the positive answer "Yes" the central processing unit determines the velocity on the basis of the sound waveform WN, and produces the note-on key event data code for the after-tone. The central processing unit supplies the note-on key event data code to the electronic tone generating system 25 as by step S9. The electronic tone generating system 25 is responsive to the note-on key event data code for the after-tone so that the after-tone is produced through the electronic tone generating system 25.

When the central processing unit transfers the note-on key event data code to the electronic tone generating system 25, the central processing unit starts to measure the gate time g(VN), and periodically checks the internal clock to see whether or not the gate time g(VN) is expired as by step S10. While the lapse of time is shorter than the gate time g(VN), the answer at step S10 is given negative "No", and the central processing unit waits for the expiry of gate time g(VN).

When the lapse of time becomes equal to the gate time g(VN), the answer at step S10 is changed to affirmative "Yes", and the central processing unit produces the note-off key event data code for the after-tone. The central processing unit transfers the note-off key event data code to the electronic tone generating system 25 as by step S11. The electronic tone generating system 25 is responsive to the note-off key event data code so as to decay the after-tone.

Thus, the central processing unit reiterates the loop consisting of steps S1 to S11 for producing the after-tones until the end of performance. When the player concurrently depresses and releases more than one key 1*b* and 1*c*, the central processing unit carries out the above-described jobs for each of the depressed keys 1*b* and 1*c* and each of the released keys 1*b* and 1*c*.

As will be understood from the foregoing description, the electronic system 20 is responsive to the fingering on the keyboard 1*a* so as to produce the after-tones AT as well as the regular tones RT. Thus, the human player can easily perform a music passage in tremolo. In case where the human player selects the timbre of harpsichord tones, the electronic tone generating system 25 is responsive to the user's request so as to permit the player to perform pieces of music through the electronic harpsichord tones. Moreover, if the user selects the timbre of guitar tones, the player can easily perform the tremolo through the regular tones and after-tones.

Figure 7:
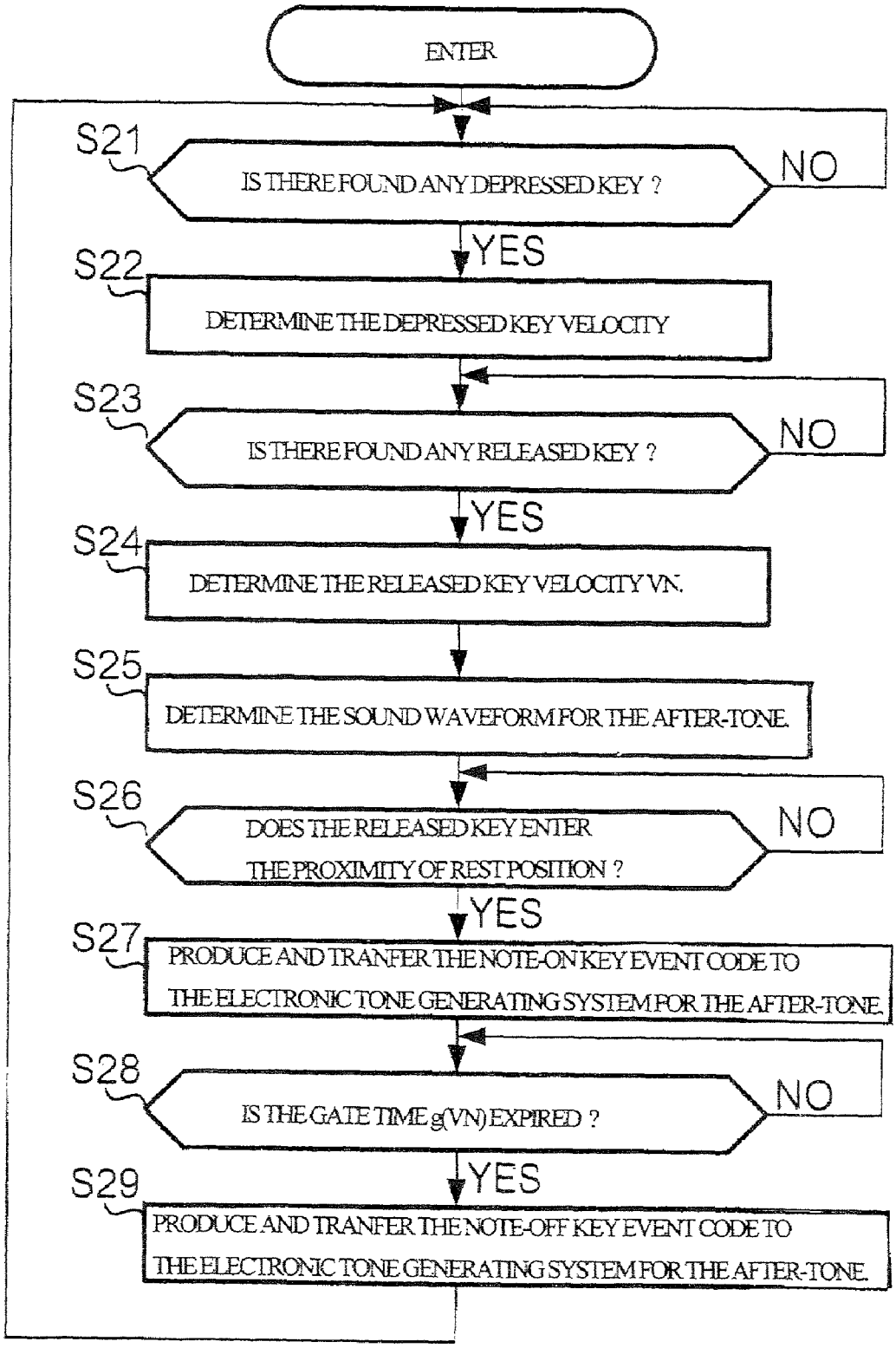
FIG. 7 is a flowchart showing a job sequence for the second behavior of the automatic player musical instrument.

A user is assumed to select the second performance mode together with the second tone generating mode or third tone generating mode, i.e., the second behavior. In the second behavior, the automatic player musical instrument 100 produces the electronic tones as the after-tones. When a user instructs the automatic player musical instrument 100 to perform a piece of music in the second behavior, the central processing unit checks the working memory to see whether or not the hammer stopper 31 stays at the blocking position. If the answer is given affirmative, the central processing unit makes the stepping motor 32 keep the hammer stopper 31 at the blocking position. On the other hand, if the answer is given negative, the central processing unit supplies the control signal to the motor driver so as to make the stepping motor 32 change the hammer stopper 31 to the blocking position. After the entry into the blocking position, the main routine program starts periodically to branch the subroutine program for the after-tones, and reiterates a loop of jobs for each of the depressed keys 1*b* and 1*c* as shown in FIG. 7. The job sequence shown in FIG. 7 is executed for each of the depressed keys 1*b* and 1*c* and after the release of the depressed key 1*b* or 1*c*. If more than one key 1*b*/1*c* is concurrently depressed, the job sequence is executed in multiple for these keys 1*b* and 1*c*. In the following description on the job sequence, the player is assumed to depress one of the black keys 1*b* and, thereafter, releases the black key 1*b* without any other depressed key for the sake of simplicity.

The central processing unit periodically fetches the pieces of key position data from the input-and-output circuit assigned to the key position sensors 26 for all of the black keys 1*b* and white keys 1*c* and stores the pieces of key position data in the working memory. The accumulation of pieces of key position data is carried out until the player releases the automatic player musical instrument 100 from the second behavior.

The central processing unit checks the working memory to see whether or not the black key 1*b* is depressed as by step S21. While the black key 1*b* is staying at the rest position, or white the black key 1*b* is traveling on the locus before the key position K3, the answer at step S21 is given negative "No", and the central processing unit repeatedly carries out the job at step S21.

Figure 8A:
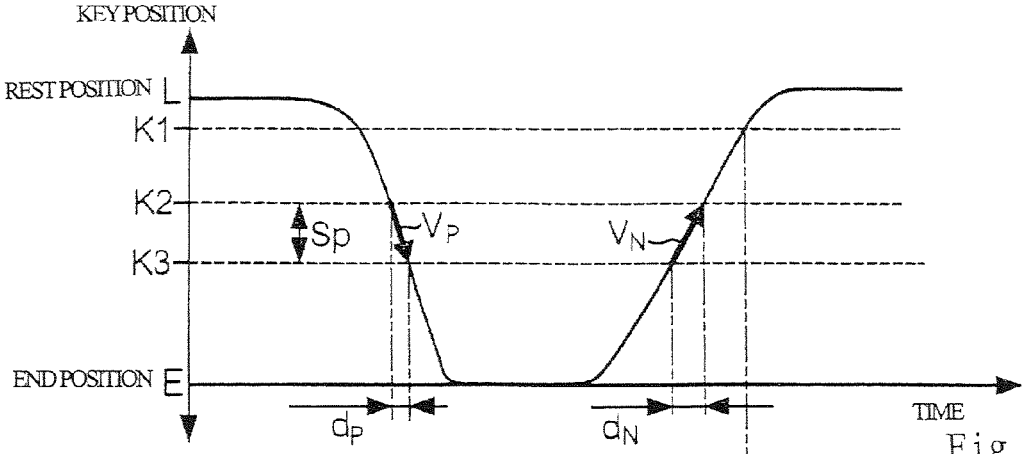
FIG. 8A is a graph showing the locus of a key in the second behavior.
Figure 8B:
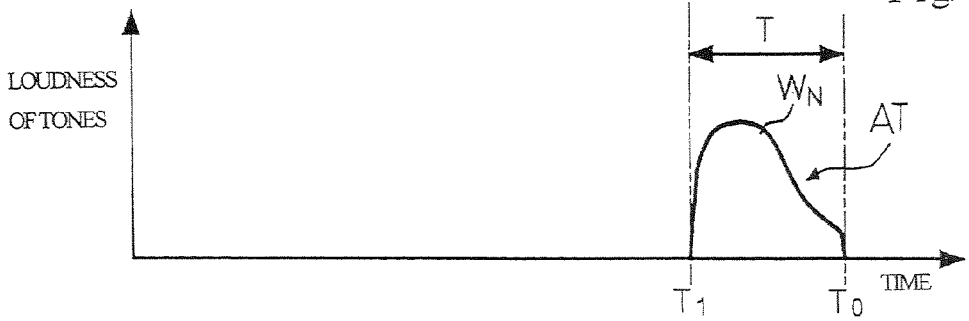
FIG. 8B is a graph showing the electronic tone produced in the second behavior.

When the black key 1*b* passes through the key position K3, the answer at step S21 is changed to affirmative "Yes", and the central processing unit divides the distance Sp by the lapse of time dp (see FIG. 5A) so as to determine the depressed key velocity Vp as by step S22. The central processing unit stores the depressed key velocity Vp in the working memory, and determines the sound waveform Wp. The sound waveform Wp is also stored in the working memory. However, any note-on key event data code is produced for the regular tone as shown in FIG. 8B. For this reason, any regular tone is not produced through the electronic tone generating system 25.

The depressed key 1*b* reaches the deepest key position, and, thereafter, is released. The central processing unit checks the working memory to see whether or not the depressed key 1*b* is released as by step S23. While the released key 1*b* is traveling on the locus before the key position K2, the answer at step S23 is given negative "No", and the central processing unit repeats the job at step S23.

When the released key 1*b* passes through the key position K2, the answer at step S23 is changed to affirmative "Yes". With the positive answer, the central processing unit divides the distance Sp by the lapse of time dN (see FIG. 8A) so as to determine the released key velocity VN as by step S24.

Subsequently, the central processing unit reads out the depressed key velocity Vp and sound waveform Wp and determines the sound waveform WN on the basis of the depressed key velocity Vp, sound waveform Wp, released key velocity VN and time periods TN and TA as similar to the sound waveform WN in the first behavior.

The central processing unit checks the working memory to see whether or not the released key 1*b* enters the proximity of rest position L as by step S26. While the released key 1*b* is traveling on the locus before the key position K1, the answer at step S26 is given negative "No", and the central processing unit repeats the job at step S26.

When the released key 1*b* passes through the key position K1, the answer at step S26 is changed to affirmative "Yes". With the positive answer, the central processing unit produces the note-off key event data code for the after-tone, and transfers the note-off key event data code to the electronic tone generating system 25 as by step S27. As a result, the electronic tone is generated through the electronic tone generating system 25 as the after-tone AT (see FIG. 8B).

When the released key 1*b* passes through the key position K1 the central processing unit starts to measure the gate time g(VN). The central processing unit checks the internal clock to see whether or not the gate time g(VN) is expired as by step S28. While the lapse of time is shorter than the gate time g(VN), the answer at step S28 is given negative "No", and the central processing unit repeats the job at step S28. The after-tone is continuously produced.

When the lapse of time becomes equal to the gate time g(VN), the answer at step S28 is given affirmative "Yes". Then, the central processing unit produces the note-off key event data code for the after-tone, and transfers the note-off key event data code to the electronic tone generating system 25 as by step S29. As a result, the after-tone is decayed.

As will be understood from the foregoing description, although the depressed keys 1*b* and 1*c* does not make the electronic tone generating system 25 produce any electronic tones as the regular tones, the after-tones AT are produced in response to the released keys 1*b* and 1*c*. The after-tones AT in the second behavior are like the tones produced in the syncopation. Thus, the automatic player musical instrument 100 makes it possible enrich the style of renditions.

Figure 9:
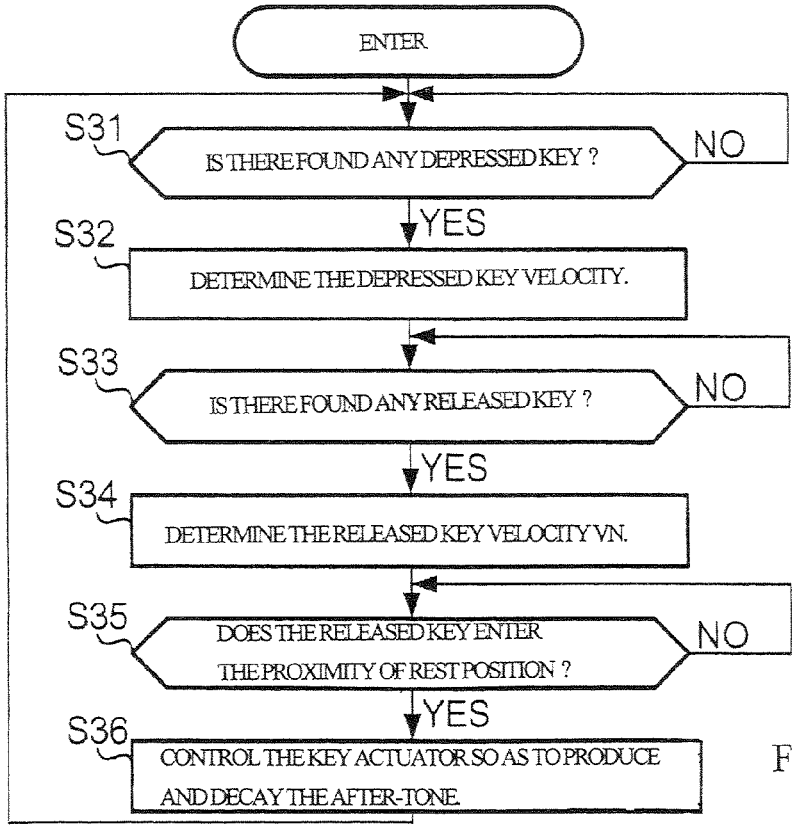
FIG. 9 is a flowchart showing a job sequence for the third behavior of the automatic player musical instrument.

A user is assumed to select the third performance mode together with the fourth tone generating mode, i.e., the third behavior. In the third behavior, the automatic player musical instrument 100 produces the acoustic tones as both of the regular tones and after-tones. When a user instructs the automatic player musical instrument 100 to perform a piece of music in the third behavior, the central processing unit checks the working memory to see whether or not the hammer stopper 31 stays at the free position. If the answer is given affirmative, the central processing unit makes the stepping motor 32 keep the hammer stopper 31 at the free position. On the other hand, if the answer is given negative, the central processing unit supplies the control signal to the motor driver so as to make the stepping motor 32 change the hammer stopper 31 to the free position. After the entry into the free position, the main routine program starts periodically to branch the subroutine program for the after-tones, and reiterates a loop of jobs for each of the depressed keys and released 1*b* and 1*c* as shown in FIG. 9. The job sequence shown in FIG. 9 is executed for each of the depressed keys 1*b* and 1*c* and after the release of the depressed key 1*b* or 1*c*. If more than one key 1*b*/1*c* is concurrently depressed, the job sequence is executed in multiple for these keys 1*b* and 1*c*. In the following description on the job sequence, the player is assumed to depress one of the black keys 1*b* and, thereafter releases the black key 1*b* without any other depressed key for the sake of simplicity.

The central processing unit periodically fetches the pieces of key position data from the input-and-output circuit assigned to the key position sensors 26 for all of the black keys 1*b* and white keys 1*c*, and stores the pieces of key position data in the working memory. The accumulation of pieces of key position data is carried out until the player releases the automatic player musical instrument 100 from the second behavior.

The central processing unit checks the working memory to see whether or not the black key 1*b* is depressed as by step S31. While the black key 1*b* is staying at the rest position, or white the black key 1*b* is traveling on the locus before the key position K3, the answer at step S31 is given negative "No", and the central processing unit repeatedly carries out the job at step S31.

Figure 10A:
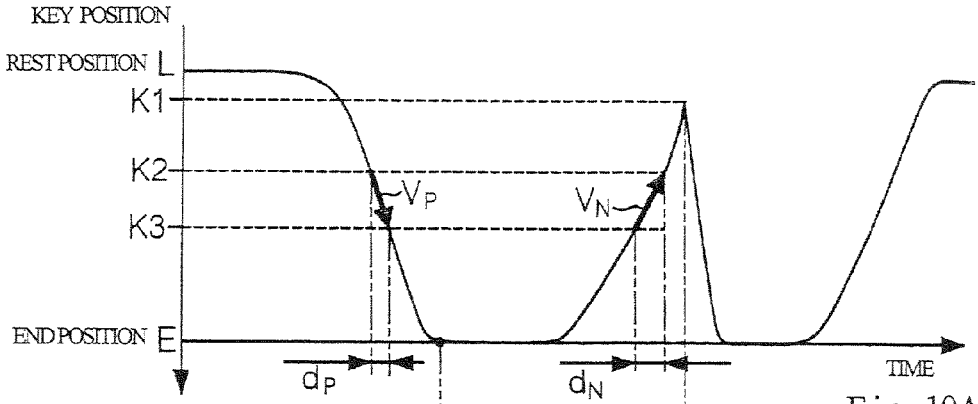
FIG. 10A is a graph showing the locus of a key in the third behavior.

When the black key 1*b* passes through the key position K3, the answer at step S31 is changed to affirmative "Yes", and the central processing unit divides the distance Sp by the lapse of time dp so as to determine the depressed key velocity Vp as by step S32. (See FIG. 10A.) The central processing unit stores the depressed key velocity Vp in the working memory, and determines the sound waveform Wp. The sound waveform Wp is also stored in the working memory.

Figure 10B:
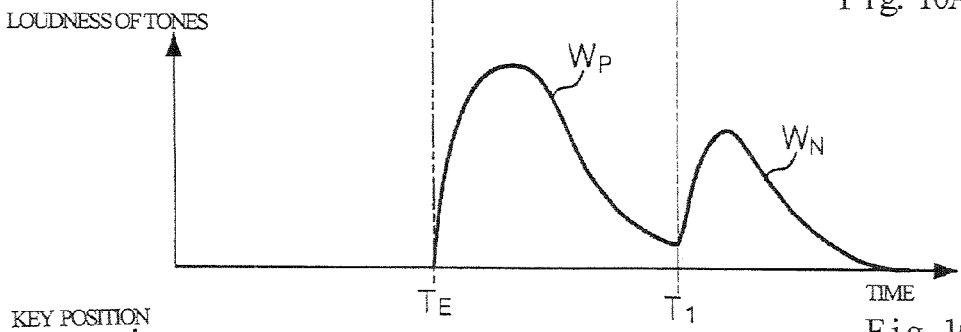
FIG. 10B is a graph showing the electronic tone produced in the third behavior.

The depressed key 1*b* actuates the associated 3, and the hammer 2 is driven for rotation through the escape of jack from the hammer 2. The hammer 2 is brought into collision with the string 4, and gives rise to the vibrations of string 4. Thus, the acoustic piano tone is produced through the vibrations of string 4 as the regular tone. (See FIG. 10B.) The hammer 2 rebounds on the string 4, and is captured by the back check 7.

The depressed key 1*b* reaches the deepest key position, and, thereafter, is released. The action unit 3 and hammer 2 are moved toward the rest position together with the released key 1*b*. The central processing unit checks the working memory to see whether or not the depressed key 1*b* is released as by step S33. While the released key 1*b* is traveling on the locus before the key position K2, the answer at step S33 is given negative "No", and the central processing unit repeats the job at step S33.

When the released key 1*b* passes through the key position K2, the answer at step S33 is changed to affirmative "Yes". With the positive answer, the central processing unit divides the distance Sp by the lapse of time dN so as to determine the released key velocity VN as by step S34, and further determines the gate time g(VN).

Subsequently, the central processing unit reads out the depressed key velocity Vp and sound waveform Wp, and determines the sound waveform WN on the basis of the depressed key velocity Vp, sound waveform Wp, released key velocity VN and time periods TN and TA as similar to the sound waveform WN in the first and second behaviors.

The central processing unit checks the working memory to see whether or not the released key 1*b* enters the proximity of rest position L as by step S35. While the released key 1*b* is traveling on the locus before the key position K1, the answer at step S35 is given negative "No", and the central processing unit repeats the job at step S35.

When the released key 1*b* passes through the key position K1, the answer at step S35 is changed to affirmative "Yes". With the positive answer, the central processing unit determines the velocity, and produces the note-on key event data code for the after-tone. The central processing unit transfers the note-on key event data code to the piano controller 12*a*. The piano controller 12*a* produces the reference forward key trajectory on the basis of the note-on key event data code, and starts periodically to supply the piece of target key position data to the servo controller 12*b*. The servo controller 12*b* forces the black key 1*b* to travel on the reference forward key trajectory through the servo control loop. The black key 1*b* actuates the action unit 3, again, and the actuated action unit 3 causes the hammer 2 to be driven for rotation through the escape of jack from the hammer 2. The hammer 2 is brought into collision with the string 4, and gives rise to the vibrations of string 4. Thus, the acoustic piano tone is produced through the vibrations of string 4 as the after-tone.

When the lapse of time becomes close to the gate time g(VN), the central processing unit produces the note-off key event data code for the after-tone, and transfers the note-off key event data code to the piano controller. The piano controller 12*a* determines the reference backward key trajectory, and the servo controller 12*b* forces the released key 1*b* to travel on the reference backward key trajectory. As a result, the black key 1*b* returns toward the rest position. The damper 6 is brought into contact with the vibrating string 4 at the end of gate time g(VN), and the after-tone is decayed as by step S36.

As will be understood, the automatic player musical instrument 100 makes it possible to perform any one of the acoustic piano tones in the tremolo.

The first, second and third behaviors are selectable by human players, and make it possible to offer a wide variety of style of renditions to human players.

Second Embodiment

Figure 11B:
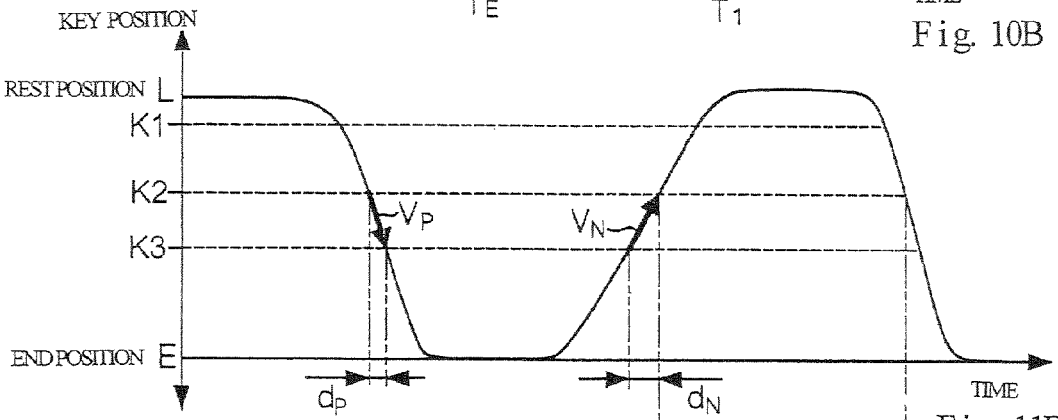
FIG. 11B is a graph showing the locus of a key of the automatic player musical instrument.
Figure 11C:
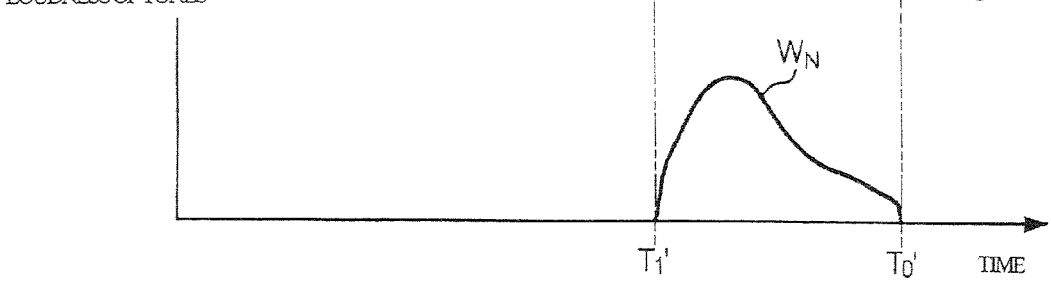
FIG. 11C is a graph showing the after-tone produced in response to the key movement.
Figure 11A:
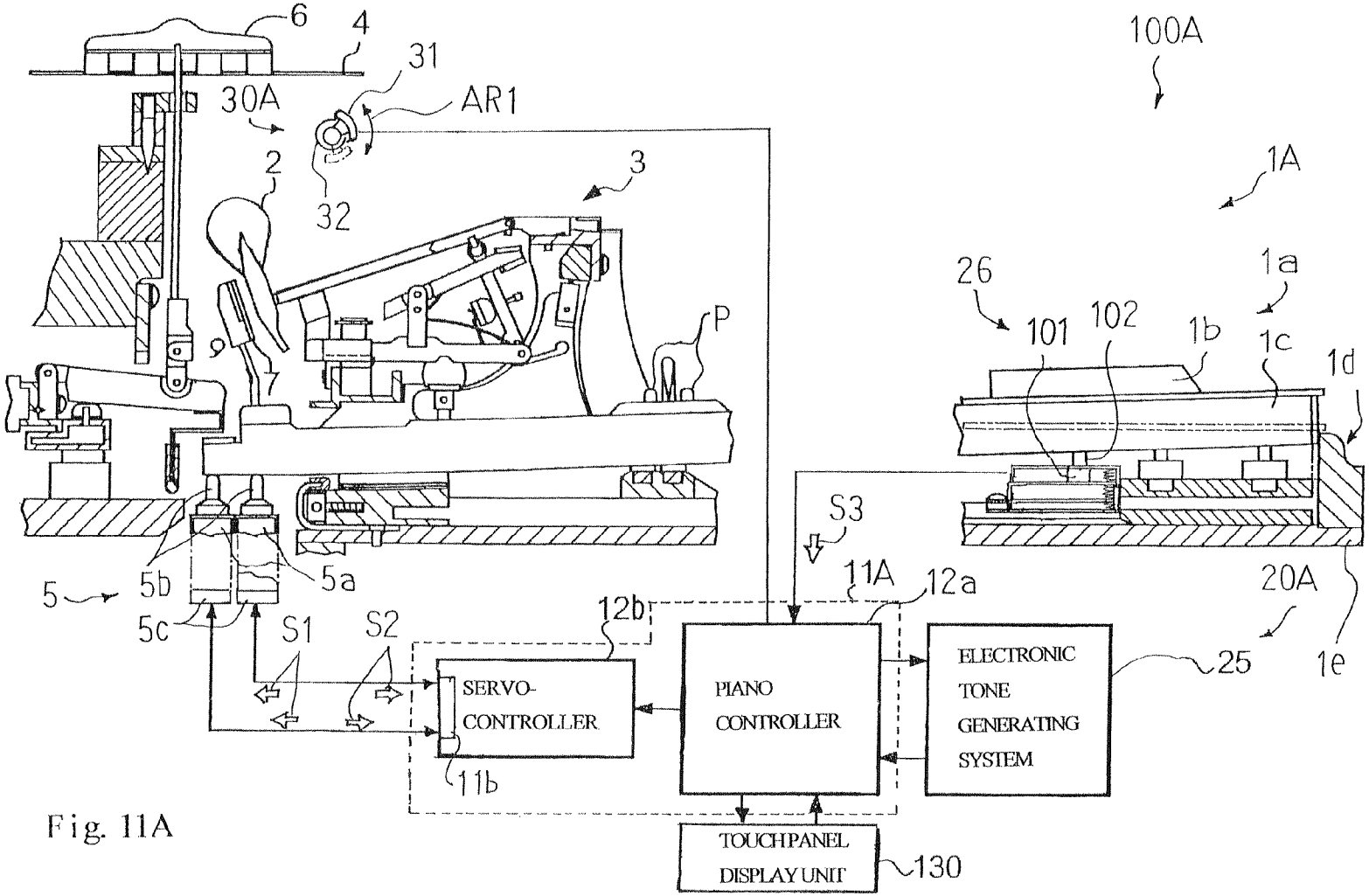
FIG. 11A is a cross sectional side view showing the structure of another automatic player musical instrument of the present invention.

Turning to FIG. 11A of the drawings, another automatic player musical instrument 100A largely comprises an acoustic piano 1A, an electronic system 20A and a muting system 30A. Since the acoustic piano 1A and muting system 30A are similar in structure to the acoustic piano 1 and muting system 30, the component parts of acoustic piano 1A and component parts of muting system 30A are labeled with references designating the corresponding component parts of acoustic piano 1 and corresponding component parts of muting system 30 without detailed description. The electronic system 20A is same as the electronic system 20 except for software installed in the controller 11A. For this reason, description is focused on the software installed in the controller 11A, and other system components and functions are labeled with references designating the corresponding system components of controller 11 and corresponding functions.

The computer program, which is installed in the controller 11A, includes the main routine program, subroutine programs described in conjunction with the first embodiment and another subroutine program for timing to produce the after-tone and timing to decay the after-tone. While the main routine program is running on the central processing unit of controller 11A, a user is assumed to wish to change the timing for the after-tone. He or she selects the job "Timing Change" on the touch panel display unit 130. Then, the main routine program starts periodically to branch to the subroutine program for timing to produce the after-tone and timing to decay the after-tone.

In this instance, the central processing unit produces an image of key movement such as, for example, the locus shown in FIG. 11B on the touch panel display unit 130, and prompts the user to specify the timing to produce the after-tone and timing to decay the after-tone in possible keystroke ranges. The after-tones are not overlapped with the regular tones in so far as the user specifies the timing to produce the after-tones and timing to decay the after-tones in the possible keystroke ranges. However, if the user wishes to make the after-tones overlapped with the next regular tones, it is possible to expand the possible keystroke ranges.

The user is assumed to change the timing to produce the after-tone and timing to decay the after-tone at the transit of released key through the key position K2 and at the transit of the next depressed key 1*b* or 1*c* through the key position K2, respectively. As shown in FIG. 11C, the released key 1*b* or 1*c* passes through the key position K2 at time T1', and the next depressed key passes through the key position K2 at time T0'. The released key 1*b* or 1*c* may have a note number same as that of the next depressed key 1*b* or 1*c*, or the released key 1*b* or 1*c* and next depressed key 1*b* or 1*c* have different note numbers, respectively.

While the user is performing a music tune in any one of the first, second and third behaviors, the after-tones are produced at the transit of released keys 1*b* and 1*c* through the key position K2, and are decayed at the transit of next depressed keys 1*b* and 1*c*.

The automatic player musical instrument 100A further enriches the available style of renditions.

Third Embodiment

Figure 12A:
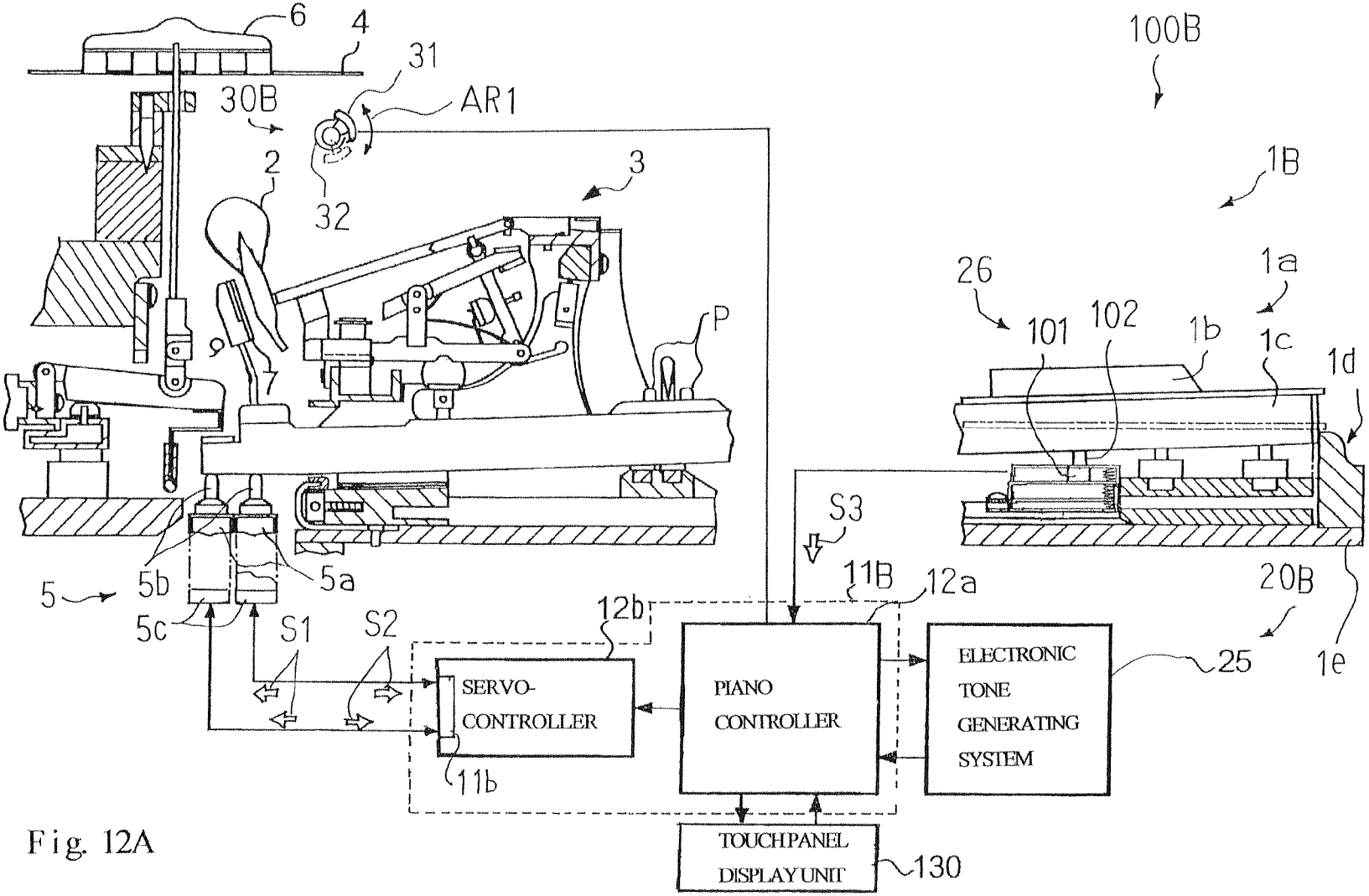
FIG. 12A is a cross sectional side view showing the structure of yet another automatic player musical instrument of the present invention.

Turning to FIG. 12A of the drawings, yet another automatic player musical instrument 100B largely comprises an acoustic piano 1B, an electronic system 20B and a muting system 30B. Since the acoustic piano 1B and muting system 30B are similar in structure to the acoustic piano 1 and muting system 30, the component parts of acoustic piano 1B and component parts of muting system 30B are labeled with references designating the corresponding component parts of acoustic piano 1 and corresponding component parts of muting system 30 without detailed description. The electronic system 20B is same as the electronic system 20 except for software installed in the controller 11B. For this reason, description is focused on the software installed in the controller 11B, and other system components and functions are labeled with references designating the corresponding system components of controller 11 and corresponding functions.

The computer program, which is installed in the controller 11B, includes the main routine program, subroutine programs described in conjunction with the first embodiment and another subroutine program for determining an interval between the regular tones and the after-tones. While the main routine program is running on the central processing unit in the controller 11B, users select a job for the interval on the touch panel display unit 130. When a user selects the job for the interval on the touch panel display unit 130, the main routine program starts periodically to branch to the subroutine program for the interval.

When the subroutine program for the interval starts to run on the central processing unit, an image of the regular tone and image of after-tone are produced on the touch panel display unit 130, and a prompt message is given to the user. The user specifies the interval between the regular tones and the after-tones on the touch panel display unit 130. When the central processing unit accepts the interval between the regular tones and the after-tones, the central processing unit changes the default interval to the interval given by the user, and stores a piece of control data expressing the interval in the working memory. Thereafter, the control returns to the main routine program.

Figure 12B:
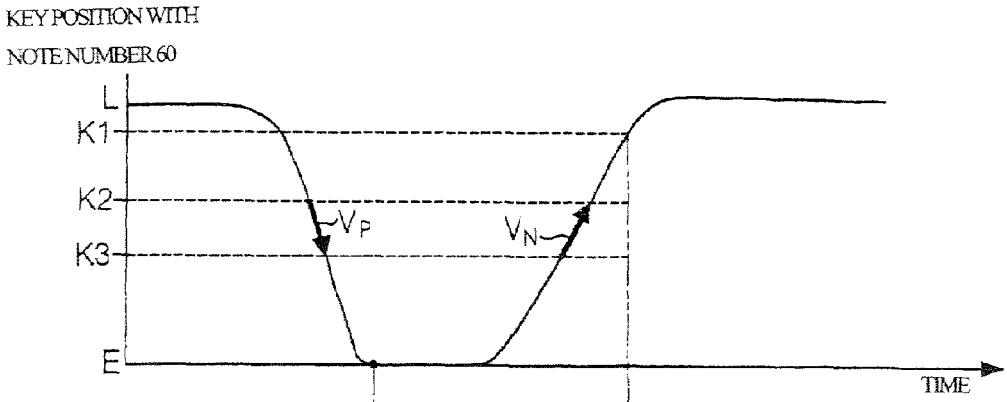
FIG. 12B is a graph showing the locus of a key of the automatic player musical instrument.

A user is assumed to specify that the interval between the regular tones and the after-tones is to be an octave. While the user is performing a music tune on the acoustic piano 1B in the third behavior, he or she is assumed to depress a key with the note number 60. The depressed key travels on the locus from the rest position L to the end position E, and is released at the end position E as shown in FIG. 12B.

Figure 12C:
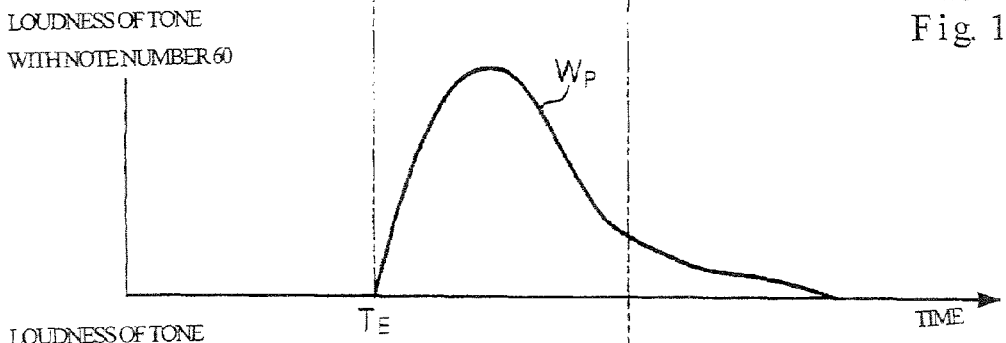
FIG. 12C is a graph showing the regular tone produced in response to the key movement.

The depressed key actuates the associated action unit 3, and the actuated action unit 3 drives the associated hammer 2 for rotation through the escape. The hammer 2 is brought into collision with the string 4 at the end of rotation, and gives rise to the vibrations of string 4 at time TE. For this reason, the acoustic piano tone, which has the pitch equivalent to the note number 60, is produced around time TE as the regular tone. (See FIG. 12C.) Although the released key 1*b* reaches the rest position L, the acoustic piano tone with the note number 60 is merely decayed.

Figure 12D:
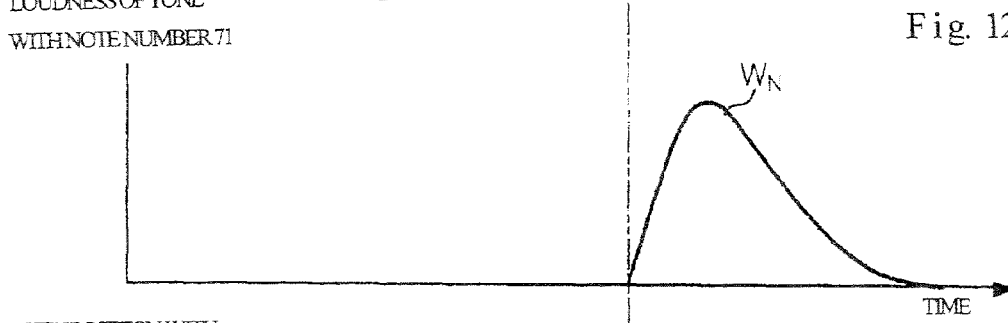
FIG. 12D is a graph showing the after-tone produced in response to the key movement.
Figure 12E:
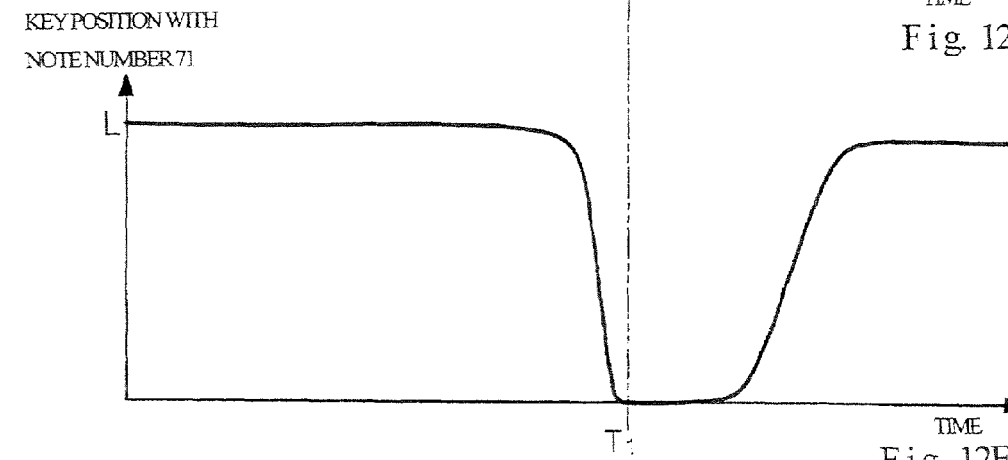
FIG. 12E is a graph showing the locus of a related key of the automatic player musical instrument.

The central processing unit looks up the piece of control data expressing the interval, and determines the note-on key event data code for the after-tone. The after-tone has the pitch equivalent to the note number 71. The note-on key event data code for the after-tone is supplies to the piano controller 12*a*, and the piano controller 12*a* determines the reference forward key trajectory for the after-tone. The servo controller 12*b* forces the key with the note number 71 to travel on the reference forward key trajectory so as to produce the acoustic piano tone as the after-tone. (See FIG. 12D.) Although the key with the note number 61 is only moved for the regular tone, the key with the note number 71 is moved for the after-tone as shown in FIG. 12E.

The velocity of the note-on key event data code is determined on the basis of the sound waveform Wp, depressed key velocity Vp and the time periods TN and TA as similar to that in the first embodiment.

In case where a user specifies that the interval is equal to the semi-tone, the user easily produces the tones in vibrato. Thus, the automatic player musical instrument 1B makes the style of renditions enriched.

Fourth Embodiment

Figure 13A:
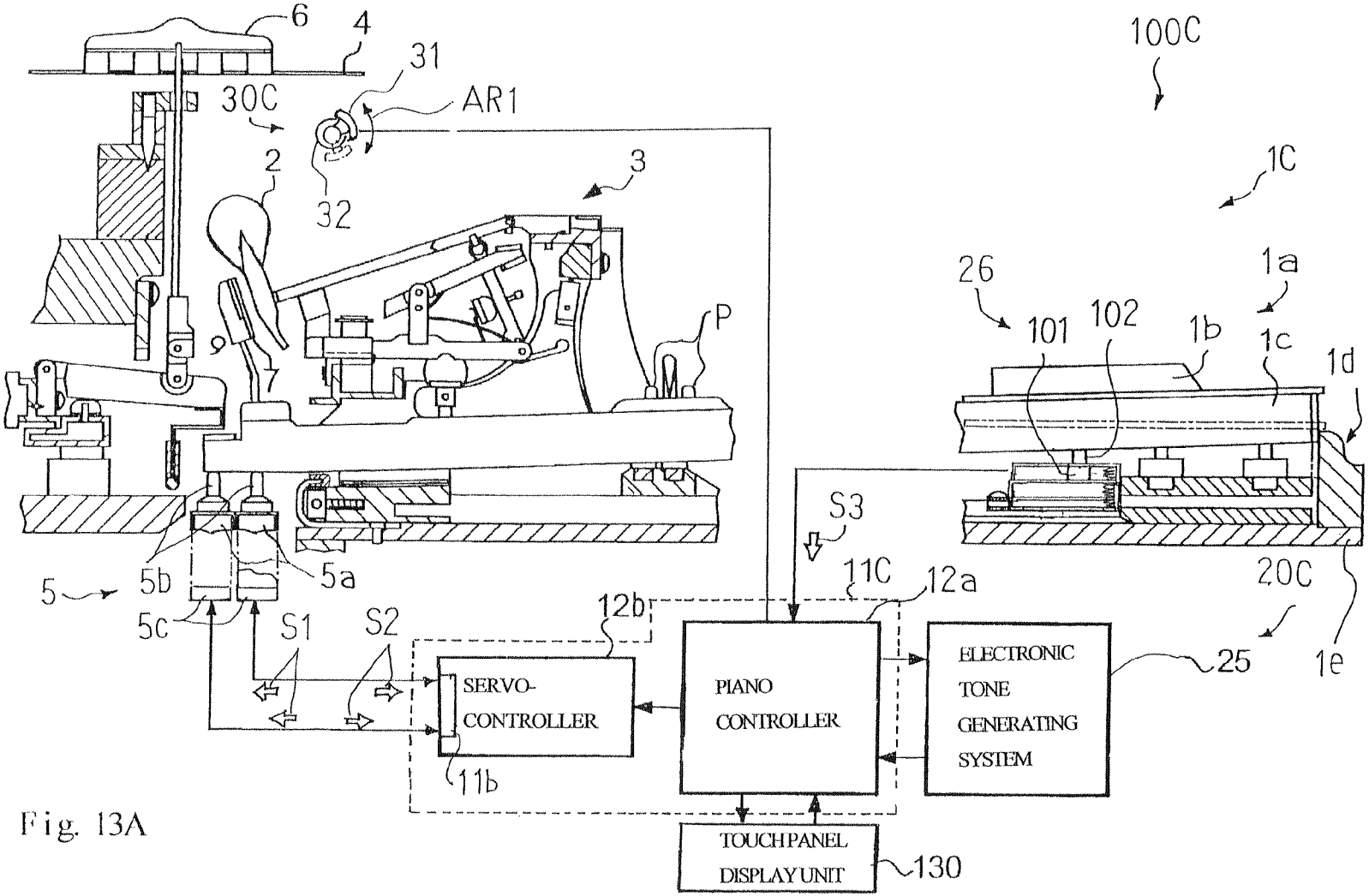
FIG. 13A is a cross sectional side view showing the structure of still another automatic player musical instrument of the present invention.

Turning to FIG. 13A, still another automatic player musical instrument 100C largely comprises an acoustic piano 1C, an electronic system 20C and a muting system 30C. Since the acoustic piano 1C and muting system 30C are similar in structure to the acoustic piano 1 and muting system 30, the component parts of acoustic piano 1C and component parts of muting system 30C are labeled with references designating the corresponding component parts of acoustic piano 1 and corresponding component parts of muting system 30 without detailed description. The electronic system 20C is same as the electronic system 20 except for software installed in the controller 11C. For this reason, description is focused on the software installed in the controller 11C and other system components and functions are labeled with references designating the corresponding system components of controller 11 and corresponding functions.

A computer program, which is installed in the controller 11C, is broken down into the main routine program subroutine programs and a subroutine program for after-tones. The main routine program and subroutine programs are similar to the main routine program and subroutine programs installed in the controller 11 except for the subroutine program for after-tones. For this reason, description is focused on the subroutine program for after-tones.

While the subroutine program for after-tones is running on the central processing unit of the controller 11C, the sound waveform WN of after-tones is determined through the execution of jobs as follows.

Figure 13B:
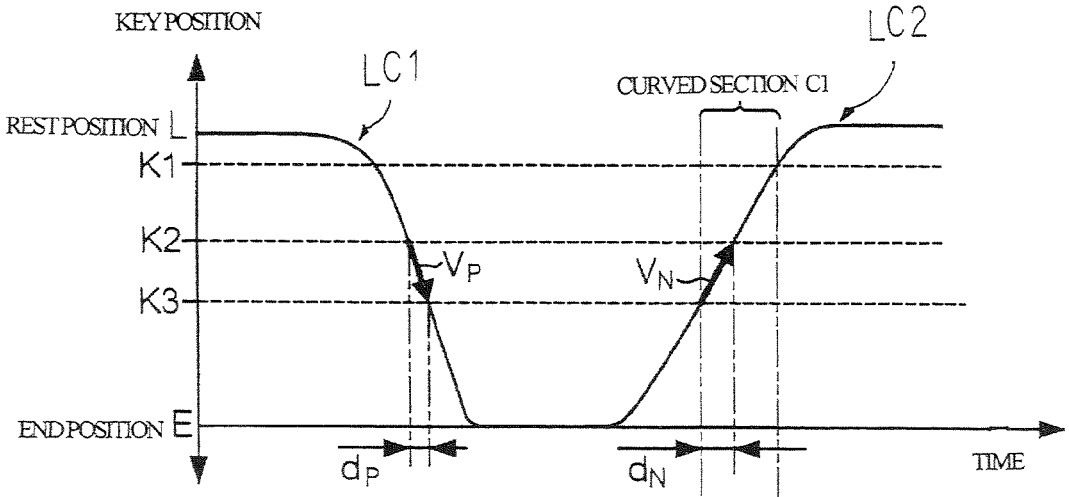
FIG. 13B is a graph showing a locus of a depressed key and a locus of released key.
Figure 13C:
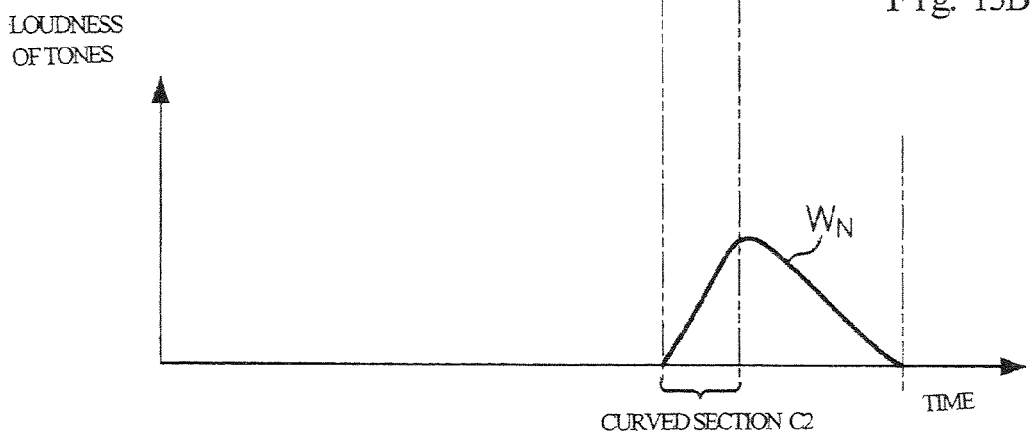
FIG. 13C is a graph showing a sound waveform of an after-tone.

A depressed key 1*b* or 1*b* and released key thereof are assumed to travel on a locus LC1 and a locus LC2 shown in FIG. 13B, respectively. Although the sound waveform WN of after-tone is roughly determined as similar to that of the first embodiment, the central processing unit takes a rate of change in a curved section C1 of the locus LC2 into account, and modifies a part of the sound waveform WN in such a manner that the part of sound waveform WN, i.e. a curved section C2 has the rate of change equal to that of the curved section C1.

The curved section C1 starts at the key position K3, and is terminated at the key position K2. On the other hand, the curved section C2 starts at the initiation of generation of after-tone, and is terminated at the maximum value of loudness. If the released key 1*b* or 1*c* travels on the curved section C1 at high-speed, the after-tone rapidly reaches the maximum loudness. On the other hand, if the released key 1*b* or 1*c* slowly travels on the curved section C1, the time period until the maximum loudness of after-tone is prolonged.

Thus, the automatic player musical instrument 100C, makes it possible to change the sound waveform of after-tones.

Fifth Embodiment

Figure 14:
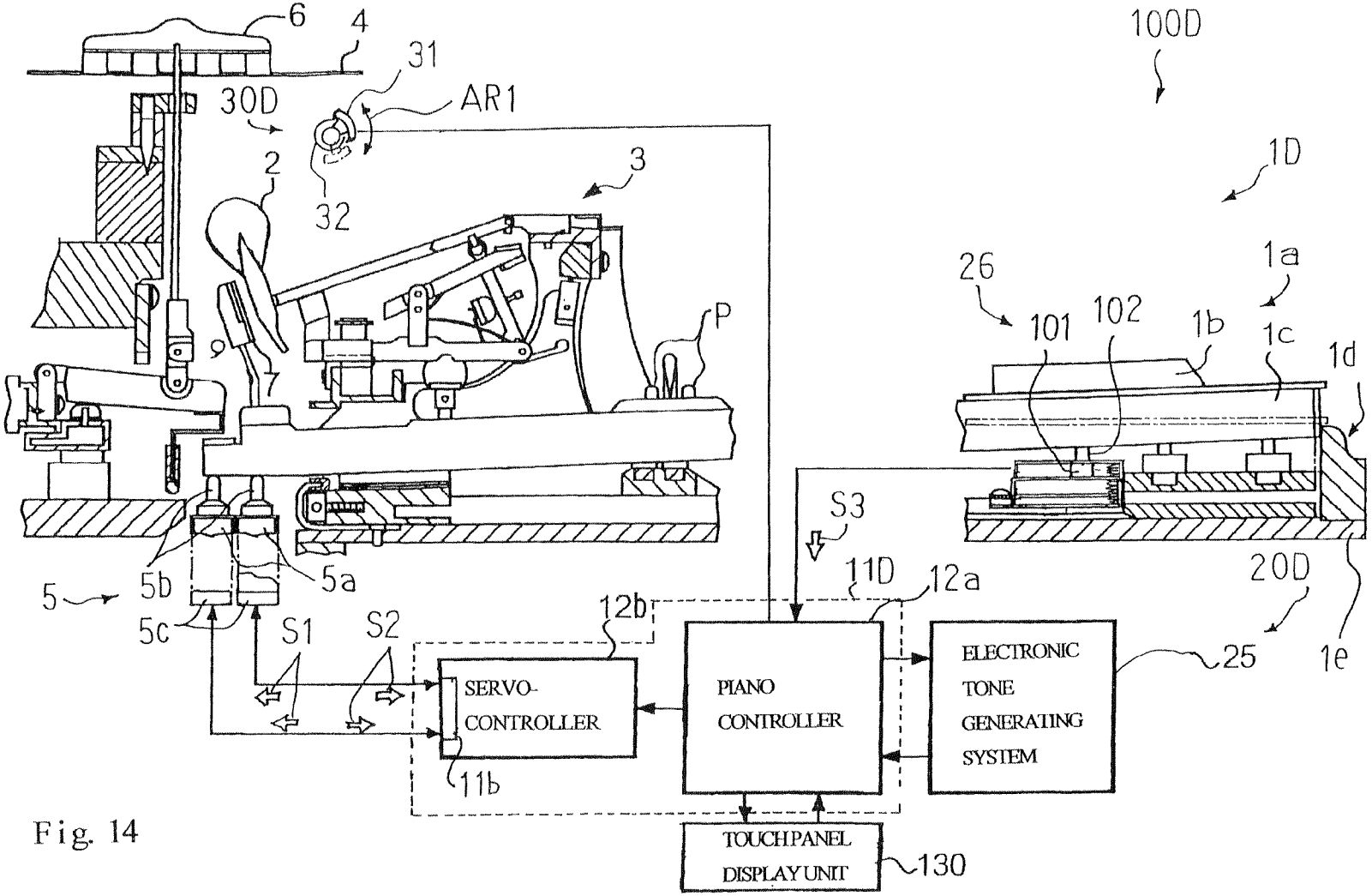
FIG. 14 is a cross sectional side view showing the structure of yet another automatic player musical instrument of the present invention.

Turning to FIG. 14 of the drawings, yet another automatic player musical instrument 100D largely comprises an acoustic piano 1D, an electronic system 20D and a muting system 30D. Since the acoustic piano 1D and muting system 30D are similar in structure to the acoustic piano 1 and muting system 30, the component parts of acoustic piano 1D and component parts of muting system 30D are labeled with references designating the corresponding component parts of acoustic piano 1 and corresponding component parts of muting system 30 without detailed description. The electronic system 20D is same as the electronic system 20 except for software installed in the controller 11D. For this reason, description is focused on the software installed in the controller 11D, and other system components and functions are labeled with references designating the corresponding system components of controller 11 and corresponding functions.

A computer program, which is installed in the controller 11D, is broken down into the main routine program subroutine programs and a subroutine program for after-tones. The main routine program and subroutine programs are similar to the main routine program and subroutine programs installed in the controller 11 except for the subroutine program for after-tones. For this reason, description is focused on the subroutine program for after-tones.

The subroutine program for after-tones permits users to select the third behavior in the automatic playing. The acoustic piano tones are produced in the automatic playing as both of the regular tones and after-tones.

A user is assumed to instruct the automatic player musical instrument 100D to produce the after-tones in the automatic playing on the acoustic piano 1D. A set of music data codes, which expresses the music tune, is transferred to the working memory, and the note-on key event data codes and note-off key event data codes are sequentially supplied to the piano controller 12*a*. The central processing unit executes the jobs in the subroutine program for automatic playing, enters the subroutine program for after-tones, and returns to the subroutine program for automatic playing. Thus, the control goes in and out from the subroutine program for automatic playing and subroutine program for after-tones.

When the piano controller starts to supply the target key position on the reference forward key trajectory to the servo controller, the central processing unit periodically enters the subroutine program for after-tones thought timer interruption, and returns to the subroutine program for automatic playing upon expiry of a predetermined time period. Therefore, the central processing unit intermittently executes the jobs shown in FIG. 9.

As will be appreciated from the foregoing description, the automatic player musical instruments 100, 100A, 100B, 100C and 100D produce the acoustic tones and/or electronic tones as at least the after-tones. In case where the automatic player musical instruments 100, 100A, 100B, 100C and 100D produces the acoustic tones as the after-tones, the electronic tones or acoustic tones are produced through the electronic tone generating system 25 or acoustic pianos 1, 1A, 1B, 1C and 1D as the regular tones, or both of the electronic tone generating system 25 and acoustic piano 1, 1A, 1B, 1C and 1D keep themselves silent for the regular tones. On the other hand, in case where the electronic tone generating system 25 produces the electronic tones as the after-tones, the acoustic pianos 1, 1A, 1B, 1C and 1D produces the acoustic tones as the regular tones, or keep themselves silent for the regular tones. Thus, the automatic player musical instrument 100, 100A, 100B, 100C and 100D permit the user easily to play music tunes in various sorts of style of renditions such as, for example, the tremolo, syncopation and vibrato.

Although particular embodiments of the present invention have been shown and described, it will be apparent to those skilled in the art that various changes and modifications may be made without departing from the spirit and scope of the present invention.

The plunger velocity sensors 5*c* and key position sensors 26 do not set any limit to the technical scope of the present invention. The velocity sensors 5*c* and position sensors 26 may be replaced with other sorts of sensors, which convert another sort of the physical quantity to electric signals, in so far as the a series of values of another sort of physical quantity expresses the movement of key 1*b*/1*c* or plunger 5*b*. Another sort of physical quantity may be acceleration.

The MIDI protocols do not set any limit to the technical scope of the pre-sent invention, because there are various sorts of digital music data protocols for musical instruments.

While a user is playing a music tune on the grand piano 1, the electronic tones may be produced on the way to the rest positions. Similarly, while a user is playing a music tune as a muting performance, the electronic tones are produced not only one of way of keys toward the end positions but also on the way of keys toward the rest positions.

It is possible to determine the key positions K1, K2 and K3 at any values of keystroke.

The method for determining the sound waveform WN and gate time g(VN) do not set any limit to the technical scope of the present invention. Only the movement of depressed keys 1*b* and 1*c* may be taken into account for the sound waveform WN and, accordingly, the loudness of after-tone. For example, although the loudness, which is expressed by the sound wave-for, WN, is determined on the basis of the depressed key velocity Vp, the gate time is made corresponding to the depressed key velocity Vp. The gate time may be fixed to a constant value, or made proportional to the time period over which the depressed keys 1*b* and 1*c* stay at the end positions. Otherwise, the loudness of after-tones is fixed to a constant value, and, on the other hand, the gate time is varied in dependence on the depressed key velocity Vp or the time period over which the depressed keys 1*b* and 1*c* stay at the end positions.

In case where a player releases the depressed keys on the way to the end positions, the keystroke may be taken into account for the sound waveform WN of after-tones. For example, the loudness of after-tones may be calculated as (the loudness of regular tones)×(the keystroke/full keystroke). The full keystroke means the keystroke between the rest position and the end position.

In the fourth embodiment, the time period until the maximum loudness is varied depending upon the rate of change of released key velocity. This feature does not set any limit to the technical scope of the present invention. The gate time may be varied together with the released key velocity. In this instance, the faster the released keys 1*b* and 1*c* are, the shorter the gate time is. In other words, the slower the released keys 1*b* and 1*c* are, the longer the gate time is.

The functions f(Vp) and g(VN) are replaced with f(T) and g(T), where T is a time period consumed to travel between predetermined two key positions. Otherwise, the function f(Vp) and g(VN) are replaced with functions f($\alpha$1) and g($\alpha$2), where $\alpha$1 is the acceleration of depressed key in predetermined two key positions and $\alpha 2$ is the acceleration of released key in predetermined two key positions.

The three performance modes and four tone generation modes do not set any limit to the technical scope of the present invention. The number of performance modes and the number of tone generation modes may be less than or greater than those of the first embodiment. A musical instrument of the present invention may have only one behavior, i.e., only one tone generation mode and only one performance mode. If a musical instrument is designed to produce electronic tones or acoustic tones as the after-tones, only, the musical instrument behaves as similar to the automatic player musical instrument 100 in the second behavior.

In the fifth embodiment, the sound waveform WN, i.e., the loudness of after-tones and gate time g(VN) are determined on the basis of the sound waveform Wp, and the sound waveform Wp is determined on the basis of the pieces of current key position. This feature does not set any limit to the technical scope of the present invention. Since the note-on key event data code and corresponding note-off key event data code offer pieces of data necessary to determine the sound waveform WN, the central processing unit may determine the loudness of after-tones and gate time on the basis of the note-on key event data code and corresponding note-off key event data code.

In another modification of the fifth embodiment, a human player performs a melody, and the automatic player produces chords and after-tones for the acoustic tones in the melody.

Any sort of key position sensors is available for musical instruments of the present invention. For example, the key position sensor 26 may be implemented by a combination of a light emitting diode and a photo transistor, the optical axes of which are crossed at a certain angle θ. In this instance, the amount of photo current is varied together with the current key position. A combination of a piece of magnet and a coil may serve as the key position sensor 26. The piece of magnet is moved together with the black key 1*b* or white key 1*c*, and the locus of piece of magnet passes through the coil. The moving magnet makes the coil varied in inductance through the electromagnetic induction, and an electric signal is taken out from the coil. A strain gauge may serve as the key position sensor 26. Each of the black keys 1*b* and white keys 1*c* exerts force on the strain gauge, and the force is varied together with the current key position.

The computer program may be stored in an information storage medium such as, for example, a magnetic tape cassette, a hard disc unit, a flexible disc, an optical disc, an optomagnetic disc, a compact disc, a DVD (Digital Versatile Disk) and a RAM stick, and is transferred from the information storage medium to the program memory of the controller 11, 11A, 11B, 11C or 11D. Otherwise, the computer program may be downloaded from a server computer through a communication network.

The acoustic pianos 1, 1A, 1B, 1C and 1D do not set any limit to the technical scope of the present invention. The acoustic piano 1, 1A, 1B, 1C or 1D may be replaced with an organ or a harpsichord. Since a celesta belongs to a percussion instrument, the acoustic piano, organ and harpsichord do not set any limit to the technical scope of the present invention.

An electronic keyboard may be designed to have the second behavior in accordance with the present invention, and permits a player easily to perform a music passage in the syncopation. Thus, the acoustic musical instruments 1, 1A, 1B, 1C and 1D do not set any limit to the technical scope of the present invention. An acoustic wind musical instrument may be equipped with the electronic tone generating system 25 for producing the after-tones.

The component parts and jobs of computer program are correlated with the claim languages as follows.

As to the first independent claim, the black keys 1*b* and white keys 1*c* serve as "plural manipulators". The hammers 2, strings 4, dampers 6, piano controller 12*a*, servo controller 12*b*, servo control loop, solenoid-operated key actuators 5, electronic tone generating system 25, subroutine program for producing electronic tones, subroutine program for automatic playing and jobs at steps S2/S3/S5 to S7/S9 to S11, S22/S24/S25/S27 to S29, S32/S34/S36 form in combination a "tone generating system".

The controller 11, 11A, 11B, 11C or 11D, key position sensors 26 and jobs at step S1, S21 or S31 serve as a "first timing generator". The controller 11, 11A, 11B, 11C, or 11D and subroutine program for producing electronic tones also serve as the "first timing generator" under the condition that the electronic tones are produced as the regular tones. The piano controller 12*a* also serves as the "first timing generator" for producing the acoustic tones as the regular tones in the automatic playing, because the piano controller 12*a* determines the reference forward key trajectories. While a human player is performing on the acoustic piano 1, 1A, 1B, 1C or 1D, the action units 3 serve as the "first timing generator", because the hammers 2 start to rotate through the escape from the jacks of action units 3.

The controllers 11, 11A, 11B, 11C and 11D, key position sensors 26 and jobs at steps S4/S8, S23/S26 and S33/S35 serve as a "second timing generator". In case where the acoustic tones are produced as the after-tones, the piano controller 12*a* serves as the "second timing generator".

The second timing generator of first independent claim is corresponding to a "timing generator" of another independent claim.

The controllers 11, 11A, 11B, 11C and 11D serve as a "controller", and the solenoid-operated key actuators 5 are corresponding to "actuators".

The hammers 2, strings 4 and dampers 6 form an "acoustic tone generator", and the servo controller 12*b*, servo control loop and solenoid-operated key actuators 5 form another part of the acoustic tone generator. The acoustic pianos 1, 1A, 1B, 1C and 1D serve as an "acoustic musical instrument". The electronic tone generating system 25 is corresponding to an "electronic tone generator". The controllers 11, 11A, 11B, 11C and 11D and jobs at steps S2/S6/S7, S22/S24/S25 and S32/S34 are corresponding to an "analyzer". The pitch of tones and loudness of tones are "attributes" of tones. The piano controller 12*a*, servo controller 12*b* and solenoid-operated key actuators 5 form parts of an "automatic player".

The piano controller 12*a* is corresponding to a "reference trajectory generator".

What is claimed is:

1. A musical instrument for producing regular tones and after-tones, comprising:

plural manipulators moved between respective rest positions and respective end positions;

a first timing generator determining a first sort of timing to produce said regular tones equivalent to tones be produced for the manipulators moved toward said end positions;

a second timing generator determining a second sort of timing to produce said after-tones equivalent to tones to be produced for the manipulators moved toward said rest positions; and a tone generating system provided in association with said plural manipulators, connected to said first timing generator and said second timing generator, and including an automatic player for giving rise to the movements of said plural manipulators without any fingering of a human player, an acoustic tone generator responsive to movements of said plural manipulators for producing acoustic tones as one of or both of said regular tones and after-tones at said first sort of timing, said second sort of timing or both of said first sort and second sort of timing and an electronic tone generator responsive to said movements of said plural manipulators for electronically producing electronic tones as the other of said regular tones and after-tones at said first sort of timing or said second sort of timing.

2. The musical instrument as set forth in claim 1, in which said acoustic tone generator forms a part of an acoustic musical instrument, and said automatic player produces said acoustic, tones as said after-tones through said acoustic tone generator.

3. The musical instrument as set forth in claim 1, in which said acoustic tone generator forms a part of an acoustic musical instrument so that said acoustic tones are produced through said acoustic tone generator as said regular tones and further as said after-tones with the assistance of said automatic player.

4. The musical instrument as set forth in claim 3, in which said acoustic tone generator has strings vibrating for producing said acoustic tones and hammers driven for rotation in response to fingering on said plural manipulators and brought into collision with said strings at the end of said rotation so as to give rise to the vibrations of said strings.

5. The musical instrument as set forth in claim 3, in which said acoustic tone generator is responsive to the fingering of said human player on said plural manipulators so as to produce said acoustic tones as said regular tones.

6. The musical instrument as set forth in claim 1, in which said acoustic tone generator forms a part of an acoustic musical instrument for producing said one of said regular tones and after-tones, and said electronic tone generator electronically produces said electronic tones as the other of said regular tones and after-tones.

7. The musical instrument as set forth in claim 6, in which said tone generating system further includes an analyzer analyzing the movements of said manipulators toward said end positions for producing pieces of music data expressing said after-tones, wherein said acoustic tone generator and said electronic tone generator are respectively responsive to fingering of a human player and said pieces of music data so as to produce said acoustic tones as said regular tones and said electronic tones as said after-tones, respectively.

8. The musical instrument as set forth in claim 6, in which said tone generating system further includes an analyzer analyzing the movements of said manipulators toward said end positions for producing pieces of music data expressing said regular tones and other pieces of music data expressing said after-tones, wherein said electronic tone generator and said automatic player are respectively responsive to said pieces of music data and said other pieces of music data so as respectively to produce said electronic tones as said regular tones and said acoustic tones through said acoustic tone generator as said after-tones.

9. The musical instrument as set forth in claim 7, in which said movements of said manipulators is expressed by forward velocity of said manipulators in a certain section of a locus from said rest positions to said end positions so that said analyzer determines loudness of said after-tones on the basis of said forward velocity.

10. The musical instrument as set forth in claim 1, in which said tone generating system determines a pitch of said after-tones equal to the pitch of said regular tones.

11. The musical instrument as set forth in claim 1, in which said tone generating system determines a pitch of said after-tones spaced from the pitch of said regular tones by a certain interval.

12. A musical instrument for producing after-tones in a certain mode of operation, comprising:

plural manipulators moved between respective rest positions and respective end positions;

a timing generator determining a sort of timing to produce said after-tones equivalent to tones to be produced for the manipulators moved toward said rest positions; and a tone generating system provided in association with said plural manipulators, connected to said timing generator, and producing said after-tones without said regular tones in said certain mode of operation.

13. The musical instrument as set forth in claim 12, in which said tone generating system includes an acoustic tone generator forming a part of an acoustic musical instrument, and said after-tones are produced through said acoustic tone generator.

14. The musical instrument as set forth in claim 12, in which said tone generating system includes an analyzer analyzing the movements of said manipulators toward said end positions for producing pieces of music data expressing regular tones equivalent to tones to be produced for said manipulator toward said end positions, and determining pieces of other music data expressing an attribute of said after-tones on the basis of said pieces of music data, an acoustic tone generator forming a part of an acoustic musical instrument for producing said after-tones, and an automatic player connected to said analyzer and said acoustic tone generator and responsive to said pieces of other music data so as to drive said acoustic tone generator for producing said after-tones.

15. The musical instrument as set forth in claim 14, in which said pieces of music data express at least velocity of said manipulators moved toward said end positions.

16. The musical instrument as set forth in claim 13, further comprising another timing generator determining another sort of timing to produce regular tones equivalent to tones to be produced for the manipulators moved toward said end positions and connected to said tone generating system so that said tone generating system further produces said regular tones in another mode of operation.

17. An automatic playing system for producing acoustic tones through an acoustic musical instrument, comprising:

a controller processing pieces of music data expressing at least regular tones equivalent to tones to be produced for manipulators of said acoustic musical instrument moved toward respective end positions so as to determine other pieces of music data expressing attributes of after-tones equivalent to tones to be produced for said manipulators moved toward respective rest positions; and plural actuators provided in association with said manipulators and responsive to said other pieces of music data so as to give rise to the movements of said manipulators toward said rest positions for producing said acoustic tones as said after-tones.

18. The automatic playing system as set forth in claim 17, in which said controller includes a reference trajectory generator analyzing still other pieces of music data produced from said pieces of music data so as to determine said other pieces of music data expressing at least reference forward trajectories toward said end positions, and a servo control loop connected to said reference trajectory generator and said plural actuators and responsive to said other pieces of music data so as to force said manipulators to travel on said reference forward trajectories.

19. The automatic playing system as set forth in claim 17, further comprising an electronic tone generating system producing electronic tones as said after-tones and connected to said controller so that said controller supplies said other pieces of music data to one of said plural actuators and electronic tone generating system.

20. The automatic playing system as set forth in claim 17, in which said controller further produces yet other pieces of music data expressing said regular tones, and selectively transfers said yet other pieces of said music data to said plural actuators for producing said regular tones through said acoustic musical instrument.

* * * * *